US012765667B2

(12) United States Patent
Hale et al.

(10) Patent No.: US 12,765,667 B2
(45) **Date of Patent: *Oct. 20, 2026**

(54) COLLAPSIBLE STORAGE CABINET

(71) Applicant: Quality Craft Industries, Inc., Romeoville, IL (US)

(72) Inventors: Dennis Hale, Willowbrook, IL (US); Marcus W. Bosch, Belding, MI (US); Shelley Nehrt, Barrington, IL (US); Rolando Hernandez, Romeoville, IL (US)

(73) Assignee: Quality Craft Industries, Inc., Romeoville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/615,076

(22) Filed: Mar. 25, 2024

(65) Prior Publication Data

US 2025/0160512 A1 May 22, 2025

Related U.S. Application Data

(60) Provisional application No. 63/600,039, filed on Nov. 17, 2023.

(51) Int. Cl.
*A47B 43/00* (2006.01)
*A47B 47/00* (2006.01)

(52) U.S. Cl.
CPC ..... *A47B 43/00* (2013.01); *A47B 47/00* (2013.01)

(58) Field of Classification Search
CPC ..... A47B 43/00; A47B 43/02; A47B 47/0075; A47B 47/02; A47B 47/025; A47B 47/042; A47B 47/05
See application file for complete search history.

(56) References Cited

U.S. PATENT DOCUMENTS

| | | | | |
|---|---|---|---|---|
| 655,952 | A | 8/1900 | Beerling | |
| 889,741 | A | 6/1908 | Additon | |
| 963,769 | A | 7/1910 | Johnson | |
| 1,729,475 | A | 9/1929 | Brainard et al. | |
| 2,205,826 | A | 6/1940 | Small et al. | |
| 2,934,389 | A | 4/1960 | Livingston | |
| 3,294,464 | A | 12/1966 | Harold | |
| 3,563,627 | A | 2/1971 | Whipps | |
| 3,623,784 | A * | 11/1971 | Neufeld | A47B 47/02 312/263 |

(Continued)

OTHER PUBLICATIONS

Office Action received for Canadian Patent Application No. 3233302, mailed on Sep. 12, 2025, 5 pages.

*Primary Examiner* — Matthew W Ing
(74) *Attorney, Agent, or Firm* — Shook, Hardy & Bacon L.L.P.

(57) ABSTRACT

A collapsible storage cabinet having an improved structure and assembly technique is disclosed. The storage cabinet is designed to collapse to a compact size to minimize required shipping and retail space usage, while providing for ease of assembly by a consumer and improved structural design. The collapsible storage cabinet includes a collapsible subassembly having a front wall, an opposing back wall, and a pair of folding sidewalls extending between and coupling the front wall and back wall. A top wall or collar, and a bottom wall, are selectively secured to the subassembly to maintain the cabinet in a fully assembled state.

5 Claims, 22 Drawing Sheets

(56) References Cited

U.S. PATENT DOCUMENTS

| | | | | |
|---|---|---|---|---|
| 4,288,132 | A | 9/1981 | Znamirowski et al. | |
| 5,299,704 | A | 4/1994 | Thorby | |
| 5,372,262 | A | 12/1994 | Benson et al. | |
| 5,664,854 | A | 9/1997 | Letch | |
| 6,209,976 | B1 | 4/2001 | Shear | |
| 6,478,391 | B1 | 11/2002 | Stoever | |
| 6,561,601 | B1 | 5/2003 | Maffeo | |
| 6,948,787 | B2 | 9/2005 | Mcbrayer, III et al. | |
| 7,086,707 | B2 | 8/2006 | Wyatt et al. | |
| 7,866,770 | B2 | 1/2011 | Wu | |
| 9,301,603 | B1 | 4/2016 | Koehn et al. | |
| 2007/0210682 | A1 | 9/2007 | Wise | |
| 2008/0012455 | A1 | 1/2008 | Zheng | |
| 2008/0265728 | A1* | 10/2008 | Collins | A47B 47/02 29/428 |
| 2011/0115350 | A1 | 5/2011 | Tsai et al. | |
| 2016/0100684 | A1* | 4/2016 | Koehn | A47B 57/16 312/258 |
| 2019/0328134 | A1* | 10/2019 | Walker | A47B 96/1408 |

* cited by examiner

COLLAPSIBLE STORAGE CABINET

CROSS-REFERENCE TO RELATED APPLICATIONS

This application claims the benefit of U.S. Provisional Patent Application No. 63/600,039, filed Nov. 17, 2023, entitled "Collapsible Storage Cabinet", the entire contents of which are incorporated herein by reference.

TECHNICAL FIELD

The present invention relates to a collapsible storage cabinet. More specifically, embodiments of the present invention relate to a collapsible storage cabinet having ease of assembly, improved stability when assembled, and an improved configuration for packaging when in a collapsed state.

BACKGROUND OF THE INVENTION

Storage cabinets are well known and utilized in a variety of locations in homes and businesses to satisfy several needs. Storage cabinets come in many shapes and sizes to meet these wide-ranging needs. The storage cabinets may be provided to a consumer in a fully assembled state or a disassembled state, requiring the consumer to then assemble the cabinet. From a consumer perspective, it is advantageous for the storage cabinet to be fully assembled when purchased, as it is ready to use. In fact, a number of storage cabinets are manufactured and shipped in a fully assembled state. However, shipping storage cabinets in a fully assembled state requires sizeable amounts of packaging and space when in transit, resulting in increased shipping costs. These higher costs are typically passed on to the consumer through the price of the storage cabinet. Storing fully assembled storage cabinets also requires large amounts of storage space. Occupying large amounts of both storage and display space at a retailer can result in fewer cabinets being ordered by retailers due to limited inventory/display space, and therefore fewer cabinets available for consumers to purchase.

From a manufacturer, transport, and retail perspective, it is more advantageous to provide the storage cabinet to the consumer in a disassembled state, such that the pieces of the cabinet can be packaged in a more efficient manner, such as in a flat and stackable box. However, requiring a consumer to assemble a cabinet having many pieces may prevent some consumers from purchasing the cabinet.

Furthermore, storage cabinets of the prior art which are designed to be assembled by the consumer are often times constructed in a way to promote easier assembly. However, such storage cabinets may not provide as much structural integrity as storage cabinets designed to be assembled at a factory and shipped as a finished unit.

SUMMARY

In accordance with the present invention, there is provided a novel and improved storage cabinet which seeks to overcome the shortcomings of the prior art. In an embodiment of the present invention, a collapsible storage cabinet is provided having a front wall, an opposing back wall, a pair of folding sidewalls, a top wall and a bottom wall, where the top wall and bottom walls are secured to the front, back and sidewalls in a way so as to prevent the sidewalls from folding while simultaneously providing a workspace on top of the cabinet.

In an alternate embodiment of the present invention, a top wall member and a bottom wall member for a collapsible storage cabinet is provided. The top wall member comprises a generally planar body, a plurality of wall covers oriented generally perpendicular to the generally planar body, and a plurality of flanges oriented generally perpendicular to the generally planar body and extending intermediate and below top edges of a collapsible assembly. The bottom wall member comprises a generally planar body and a pair of first support walls oriented generally perpendicular to the generally planar body with each of the first support walls also having a lip oriented parallel to the generally planar body and having one or more openings. The generally planar body of the bottom wall member is positioned intermediate and recessed within a bottom opening of the collapsible subassembly.

In another embodiment of the present invention, a collar and a bottom wall member for a collapsible storage cabinet is provided. The collar comprises a first pair of collar members having a generally planar body and extensions oriented generally parallel to the generally planar body adjacent both ends of the generally planar body. The extensions each comprise an insert extending from the extensions and oriented generally perpendicular to the extensions. The collar also comprises a second pair of collar members having a generally planar body and slit openings that align with the inserts of the first pair of collar members. The inserts of the first pair of collar members are positioned within the slit openings of the second pair of collar members to secure the first and second pair of collar members together.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
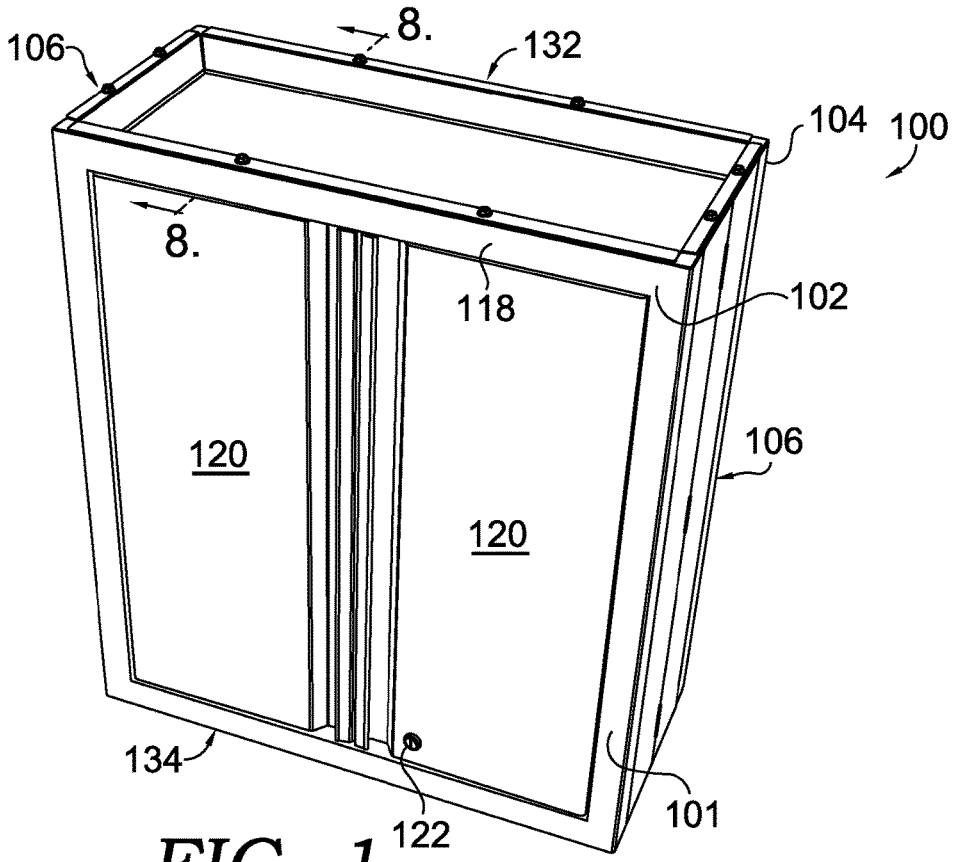
FIG. 1 is a perspective view of an embodiment of a collapsible storage cabinet in a fully assembled condition.
Figure 3:
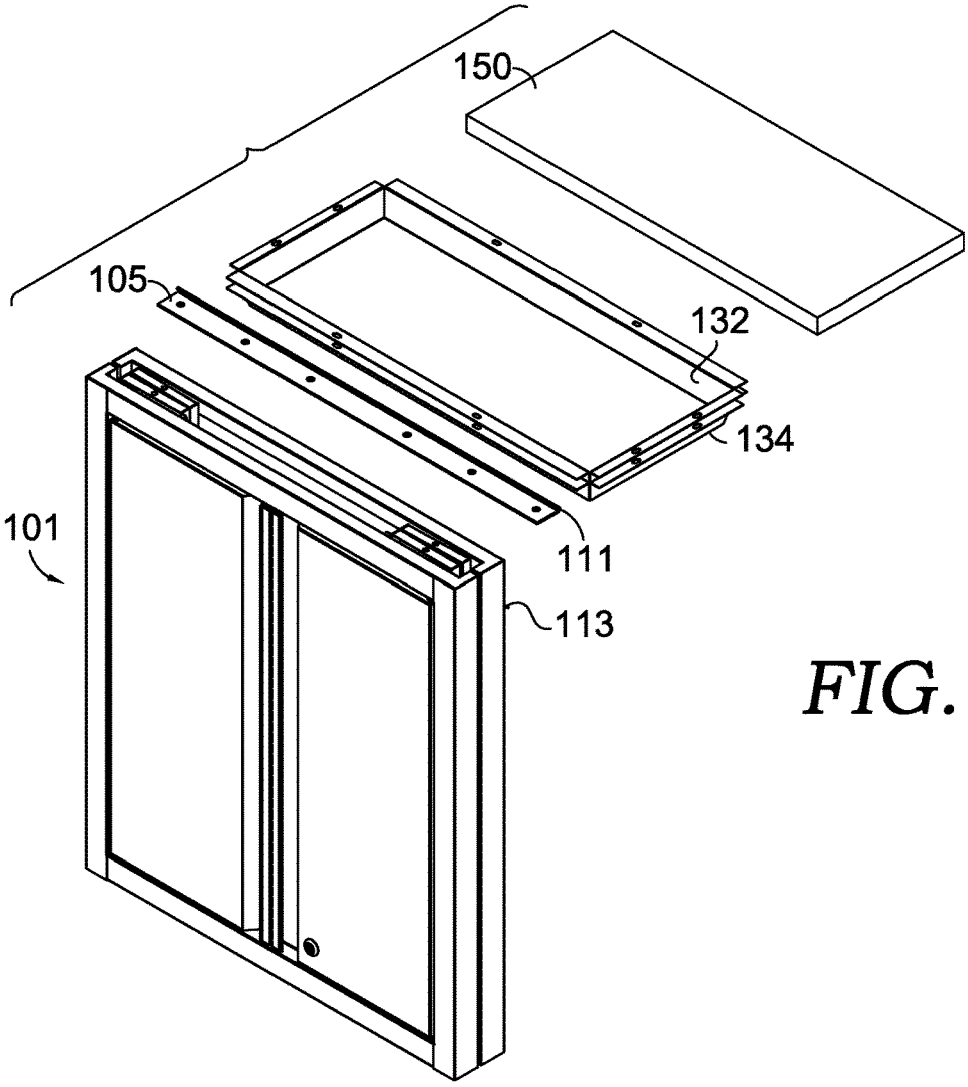
FIG. 3 is a perspective view of the storage cabinet of FIG. 1 in a collapsed condition once removed from the packaging of FIG. 2 and with portions removed from an interior cavity defined by the collapsed cabinet.

Referring initially to FIG. 1, a collapsible storage cabinet 100 is depicted in its fully assembled condition. The collapsible storage cabinet 100 of the present invention can serve a variety of uses. One such use is being in a garage to store tools, supplies or other similar equipment. The collapsible storage cabinet 100 includes a collapsible subassembly 101 having a front wall 102 and an opposing back wall 104 spaced a distance apart when the cabinet is in the fully assembled condition. Referring to FIG. 3, the collapsible storage cabinet 100 is provided with a bracket 105 for hanging the cabinet 100 from a wall, if desired. The bracket 105 would be mounted to the wall and the storage cabinet would be supported thereon by way of a lip 111 along an edge of the bracket 105 interlocking with a corresponding lip 113 extending from the back side of the back wall 104.

Figure 4:
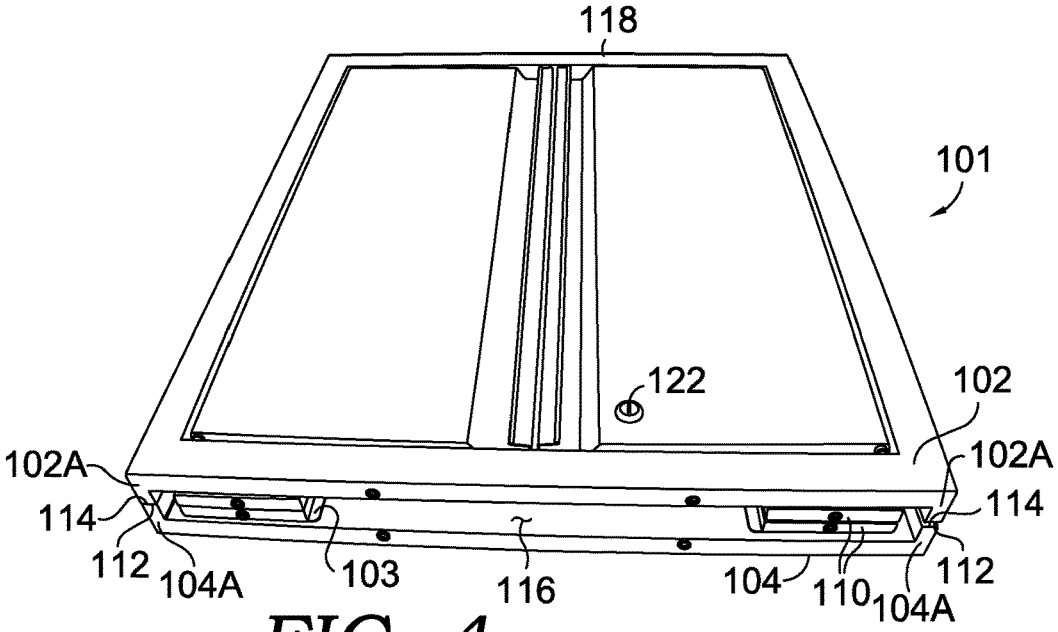
FIG. 4 is an alternate perspective view of the collapsible subassembly of the storage cabinet of FIG. 3.
Figure 5:
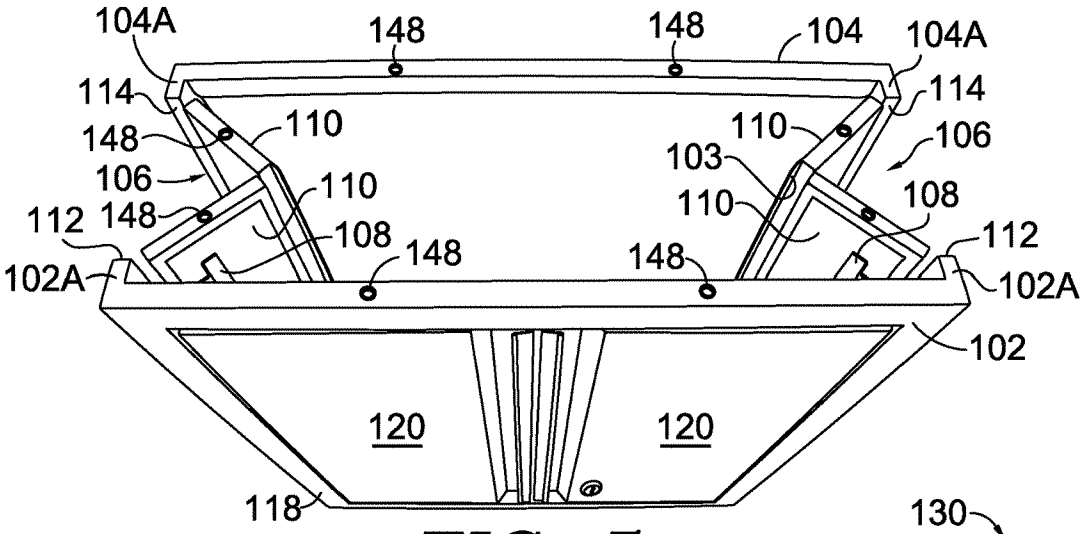
FIG. 5 is a perspective view of the storage cabinet of FIG. 3 in a partially expanded condition.

The collapsible storage cabinet 100 also comprises a pair of folding sidewalls 106 extending between and coupling the front wall 102 and back wall 104, as shown in FIGS. 1 and 5. The folding sidewalls 106 are connected to the front wall 102 and back wall 104 by a hinge 108 (FIGS. 5 and 7) or other comparable device. The hinge 108 permits the one or more panels 110, which form the sidewalls 106, to collapse as shown in FIGS. 2-5.

Figure 2:
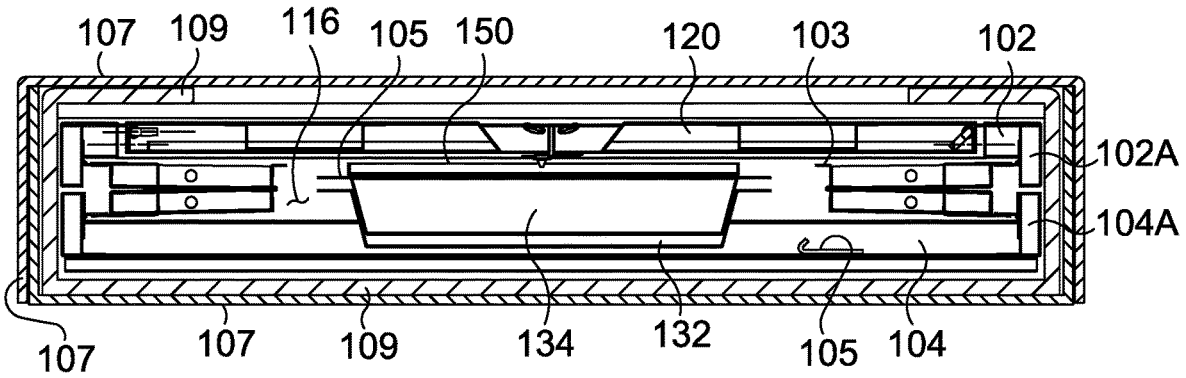
FIG. 2 is a cross-sectional side elevation view of the storage cabinet of FIG. 1 in a collapsed condition and packaged for shipment by the manufacturer.

Referring now to FIGS. 2, 4, and 5, the front wall 102 and back wall 104 each comprise additional structural features which aid in the packaging of the storage cabinet 100 in its collapsed condition for shipment and storage. More specifically, the front wall 102 further comprises a pair of extensions 102A and corresponding first pair of generally planar end faces 112 which extend from the front wall 102. The back wall 104, similarly, also has a pair of extensions 104A and a corresponding second pair of generally planar end faces 114. The first and second generally planar end faces 112 and 114 are located such that when the storage cabinet 100 is in the fully collapsed state, as shown in FIG. 4, the first pair of generally planar end faces 112 are positioned adjacent to and parallel with the second pair of generally planar end faces 114, thereby forming an interior cavity or open region 116 between the front wall 102, the back wall 104, and the collapsed sidewalls 106.

Figure 7:
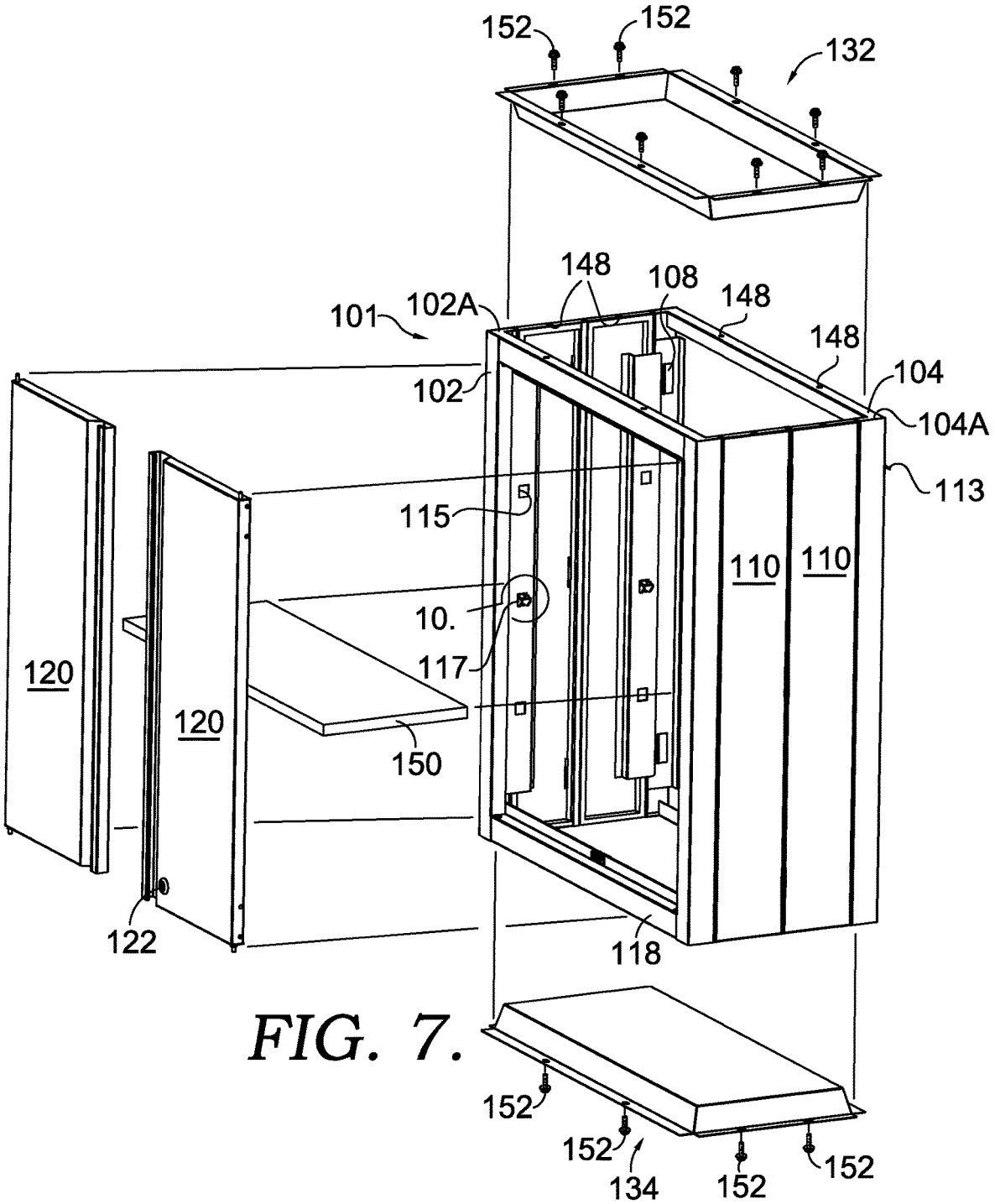
FIG. 7 is an exploded view of the storage cabinet of FIG. 1 depicting the collapsible subassembly, the top wall, the bottom wall, and the door panels.

As it can be seen in FIG. 4, when the storage cabinet 100 is in the collapsed condition, the plurality of panels 110 forming the pair of collapsible sidewalls 106 are folded so as to be in contact with each other. Furthermore, the plurality of panels 110 are folded so as to also be contained between the front wall 102 and back wall 104. That is, as can be seen in FIGS. 5 and 7, the plurality of panels 110 which form the collapsible sidewalls 106 are hinged to the extensions 102A of the front wall 102 and extensions 104A of the back wall 104 so that the hinges 108 are not visible from the exterior of the collapsible storage cabinet 100 when it is in its fully assembled position. A lip 103 extends beyond an inner edge of one of the panels 110 on each side to prevent the panels 110 from opening or flexing outward.

Figure 8:
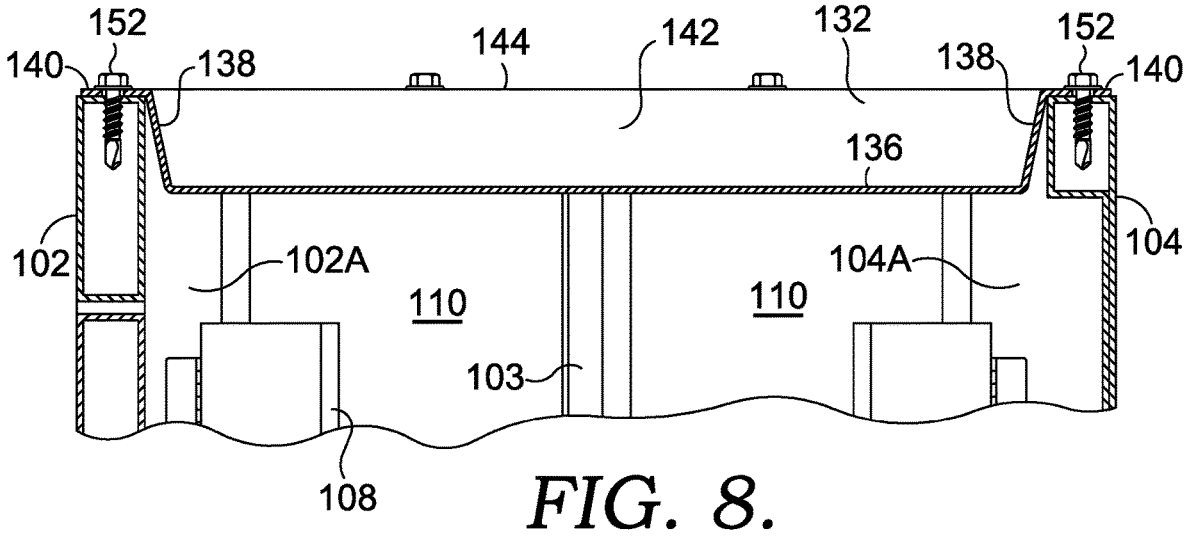
FIG. 8 is a cross-sectional view of a portion of the storage cabinet of FIG. 1 taken along the line 8-8.

Further, in the illustrated embodiment, the hinges 108 are not standard, piano-type hinges in that they do not directly couple interior corners of the extensions 102A, 104A to interior corners of the panels 110, as one would normally think a hinge would do. Instead of keeping the corners adjacent to each other throughout the collapsing of the cabinet 100, the hinges 108 are constructed to move the panels 110 between being aligned with the extensions 102A, 104A in the fully assembled position, as best illustrated in FIG. 7, to being adjacent the extensions 102A, 104A in the fully collapsed position, as best illustrated in FIG. 2. As illustrated in FIG. 2, the hinges 108 permit each panel to be moved to a location generally perpendicular to and next to or inside of, as opposed to cattycorner or diagonal, the extension to which it is connected. This moves the panels 110 out of the way so the front extensions 102A almost touch (or do touch) the rear extensions 104A. If the panels 110 were connected to the extensions 102A, 104A with piano hinges, the abutting panels 110 would space the extensions 102A, 104A further apart, thus making the depth (i.e., the vertical dimension in FIG. 2) of the collapsed cabinet unit greater. As illustrated in FIGS. 2, 5 and 8, the hinges 108 accomplish this by being attached to an inner face of the extensions 102A, 104A and an inner face of the panels 110. The hinges include an angled bracket portion that spans the space between the panels 110 and the extensions 102A, 104A in the fully assembled position.

Figure 10:
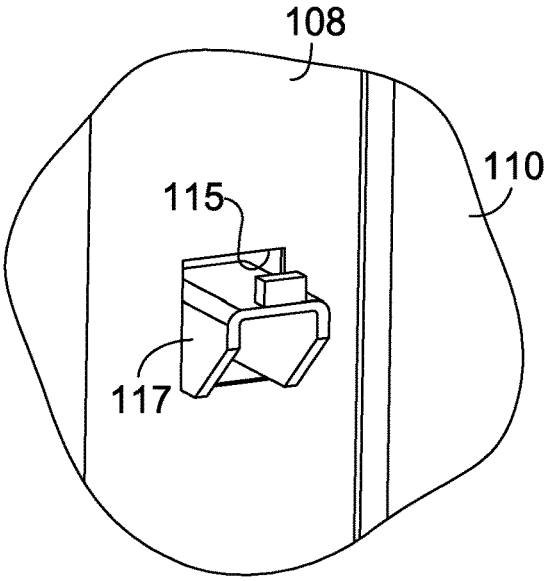
FIG. 10 is an enlarged, fragmentary, perspective view of a clip arrangement used to support a shelf in the collapsible storage cabinet taken in the area 10 of FIG. 7.

The hinges 108, as best seen in FIGS. 7 and 10, also include a plurality of openings 115 therein into which a clip 117 may be placed. A clip 117 may be placed in an opening in each of the hinges 108 at a same vertical height and the shelf 150 may be removably supported thereon.

The storage cabinet 100 further comprises a front frame 118, as shown in FIGS. 1, 4, and 5, with the front frame 118 encompassing one or more doors 120. As it can be seen from FIGS. 1, 4, 5, 7, and 9, the embodiment of the collapsible storage cabinet 100 depicted has two doors 120 which open outward, thereby providing access to the inside of the storage cabinet 100. The doors 120 are hinged to a side portion of the front frame 118 in a traditional cabinet-style arrangement. However, the exact number and arrangement of the one or more doors 120 can vary.

The one or more doors 120 and front frame 118 also include a locking mechanism 122 permitting the user of the storage cabinet 100 to selectively lock the one or more doors 120. A key type locking mechanism 122 is utilized in the collapsible storage cabinet 100 shown in FIGS. 1, 3-5, and 7. However, it is possible to utilize other types of locking mechanisms, such as a combination lock.

Figure 6:
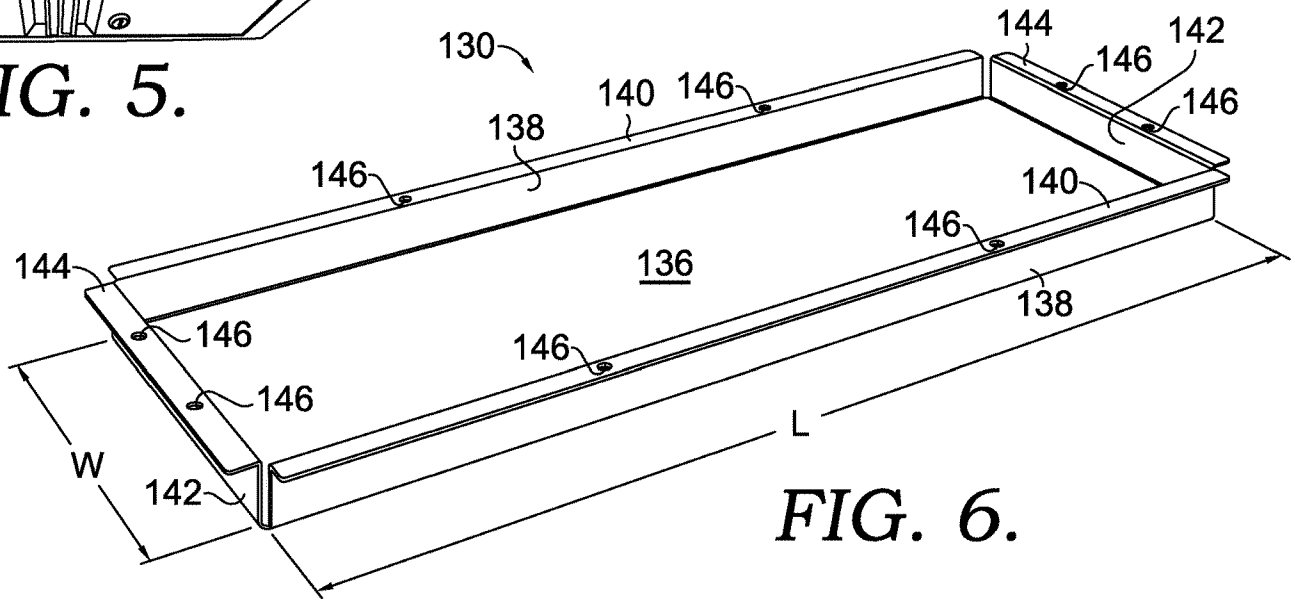
FIG. 6 is a perspective view of a top wall or bottom wall for the storage cabinet of FIG. 1.
Figure 9:
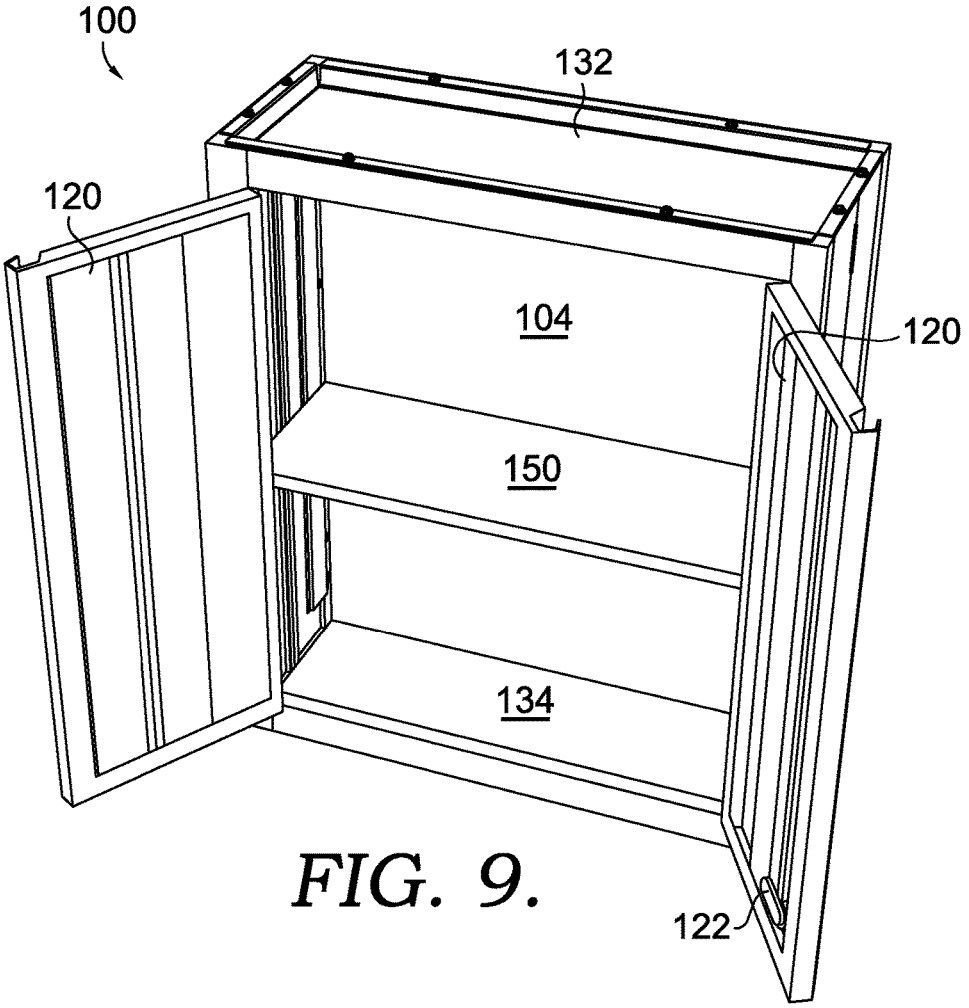
FIG. 9 is a perspective view of the storage cabinet of FIG. 1 in which the door panels are open.

Referring now to FIG. 6, the collapsible storage cabinet 100 also comprises a wall member 130 having a unique structural design. The wall member 130 is preferably used as a top wall 132 and/or a bottom wall 134 for the collapsible storage cabinet 100, as shown in FIGS. 1, 7, and 9. The wall member 130 has a generally planar body 136 having a length dimension L and a width dimension W. The wall member 130 also has a pair of first support walls 138, oriented generally perpendicular to the generally planar body 136, and a pair of first lips 140 that are parallel to the generally planar body 136. The wall member 130 also comprises a pair of second support walls 142, oriented generally perpendicular to the generally planar body 136, as well as the pair of first support walls 138. Each of the second support walls 142 also comprise a second lip 144 which, like the first lip 140, is generally parallel to the generally planar body 136. The first and second lips 140 and 144 each contain one or more openings 146 to aid in securing the top wall 132 and the bottom wall 134 to the collapsible subassembly 101. The one or more openings 146 correspond to respective openings 148 in top and bottom portions of the front wall 102, the back wall 104, and the sidewalls 106, as shown in FIGS. 5 and 7.

The wall member 130, shown in FIG. 6, can be fabricated from a single piece of sheet metal that is cut and formed to the desired shape by a bending process such as a press brake. Utilizing such a process provides an economical and reliable means of fabrication. More specifically, the wall member 130 has a generally planar body 136, which is cut and then folded on each of its four sides to form the first support walls 138 and second support walls 142. Then the first and second lips 140 and 144 are formed by bending a portion of the first and second support walls, 138 and 142, respectively. The one or more openings 146 can be placed in the wall member 130 at a convenient time in the manufacturing process.

Referring back to FIG. 2, the storage cabinet 100 shown in its collapsed and packaged condition. The collapsed condition provides a more compact product to be shipped to retailers. More specifically, the storage cabinet, when collapsed, defines an open region 116, as discussed above. The open region 116 is sized such that the top wall 132, bottom wall 134, one or more shelves 150, and the bracket 105, along with any fasteners, clips, or other hardware, can be placed within the open region 116 for purposes of packaging and shipping the collapsible storage cabinet 100. FIG. 2 also shows how the collapsible storage cabinet 100 fits within a limited amount of disposable packaging 107 (e.g., cardboard), which may or may not include multiple layers and/or padding 109 (e.g., foam) so as to protect the collapsible storage cabinet 100 when in transit.

The storage cabinet 100 of the present invention provides numerous benefits over cabinets of the prior art, some of which are quick and easy assembly, improved structural support, and enhanced storage features. As shown in FIG. 2, the collapsible storage cabinet 100 provides a more efficient packaging, thereby using less storage space for shipping and in retail locations. With respect to assembly of the collapsible storage cabinet 100, once the top wall 132, bottom wall 134, and one or more shelves 150 are removed from the packaged unit in FIG. 2, the collapsible storage cabinet 100 is opened by separating the front wall 102 from the back wall 104, as shown in FIG. 5. Then, once the folding sidewalls 106 are fully extended, the top wall 132 is secured to the upper portion of the front wall 102, the back wall 104 and the sidewalls 106, as shown in FIG. 7. A plurality of removable fasteners 152, such as screws or bolts, are placed through the one or more openings 146 in the first and second lips 140 and 144 and into the corresponding openings 148 in the front wall 102, back wall 104 and sidewalls 106. The corresponding openings 148 may be threaded such that the removable fasteners 152 engage and secure the top wall 132 to the storage cabinet 100. It is possible for other types of fasteners 152 to be used such as ¼ turn fasteners or push pin connectors. The bottom wall 134 is secured to the collapsible storage cabinet 100 in the same manner as the top wall 132. Finally, the one or more shelves 150 are placed in the storage cabinet 100, as shown in FIG. 9.

In the event the storage cabinet 100 is to be collapsed, the one or more shelves 150 are removed, the fasteners 152 are removed, and the top wall 132 and bottom wall 134 are then removed. The storage cabinet 100 can then be collapsed to the flattened condition shown in FIGS. 3 and 4.

The design of the top wall 132 and bottom wall 134 also provide increased structural stability for the storage cabinet 100. Referring to FIG. 8, a partial cross-sectional view of the storage cabinet 100 depicting the top wall 132 is shown. A similar construction occurs with respect to the bottom wall 134. This cross section view of the storage cabinet 100 shows the generally planar body 136, first support walls 138 and first lips 140. The first support walls 138, which are generally perpendicular to the generally planar body 136, are thereby generally parallel to the inner portions of the front wall 102 and back wall 104, providing increased structural rigidity to the collapsible storage cabinet 100, helping to prevent any twisting or lateral movement of the front wall 102 or back wall 104, and helping to prevent collapsing of the folding sidewalls 106. The recessed, tray-like shape of the wall member 130, provides for a portion of the wall member 130 being between the front wall 102, the back wall 104, and the sidewalls 106 when the collapsible storage cabinet 100 is in its fully assembled condition, thereby providing enhanced anti-collapsibility functionality when compared to a flat top or bottom that merely spans across the upper or lower edges of the walls 102, 104, 106.

In addition to the structural benefits discussed above, the geometry of the top wall 132 also provides an enhanced feature for the collapsible storage cabinet 100. That is, the tray-like shape of the top wall 132 allows for additional items, such as small tools or supplies, to be stored on top of the storage cabinet 100 without a risk of them falling or rolling off of the top wall 132.

The collapsible storage cabinet 100 is preferably fabricated from sheet metal such as stainless, galvanized or tool steel. However, for lighter and less rugged applications, it is possible for the collapsible storage cabinet 100 to be fabricated from lighter weight materials, such as plastic.

Figure 11:
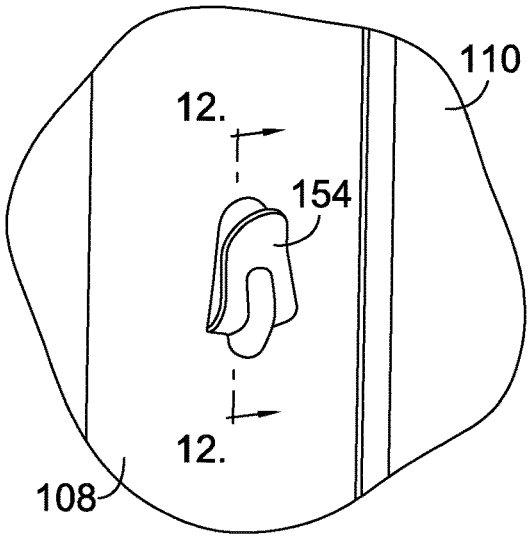
FIG. 11 is an enlarged, fragmentary, perspective view of a tongue arrangement used to support a shelf in the collapsible storage cabinet.
Figure 12:
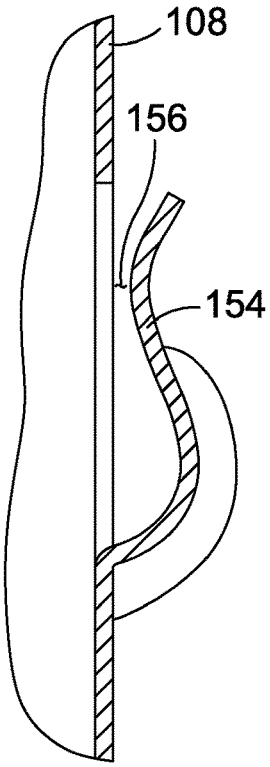
FIG. 12 is cross-sectional view of the tongue arrangement taken along the line 12-12 of FIG. 11.
Figure 13:
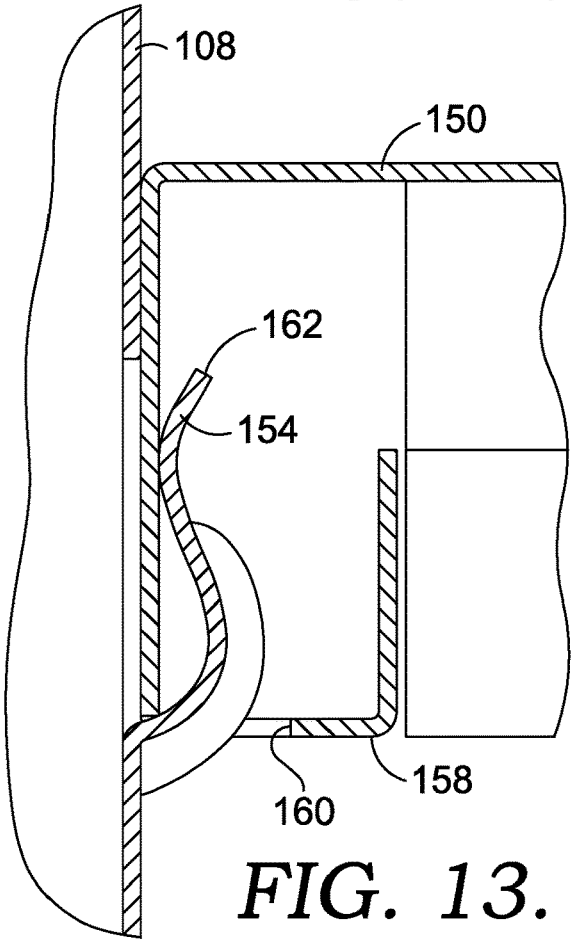
FIG. 13 is the cross-sectional view of FIG. 12, but with a shelf supported on the tongue arrangement.
Figure 14A:
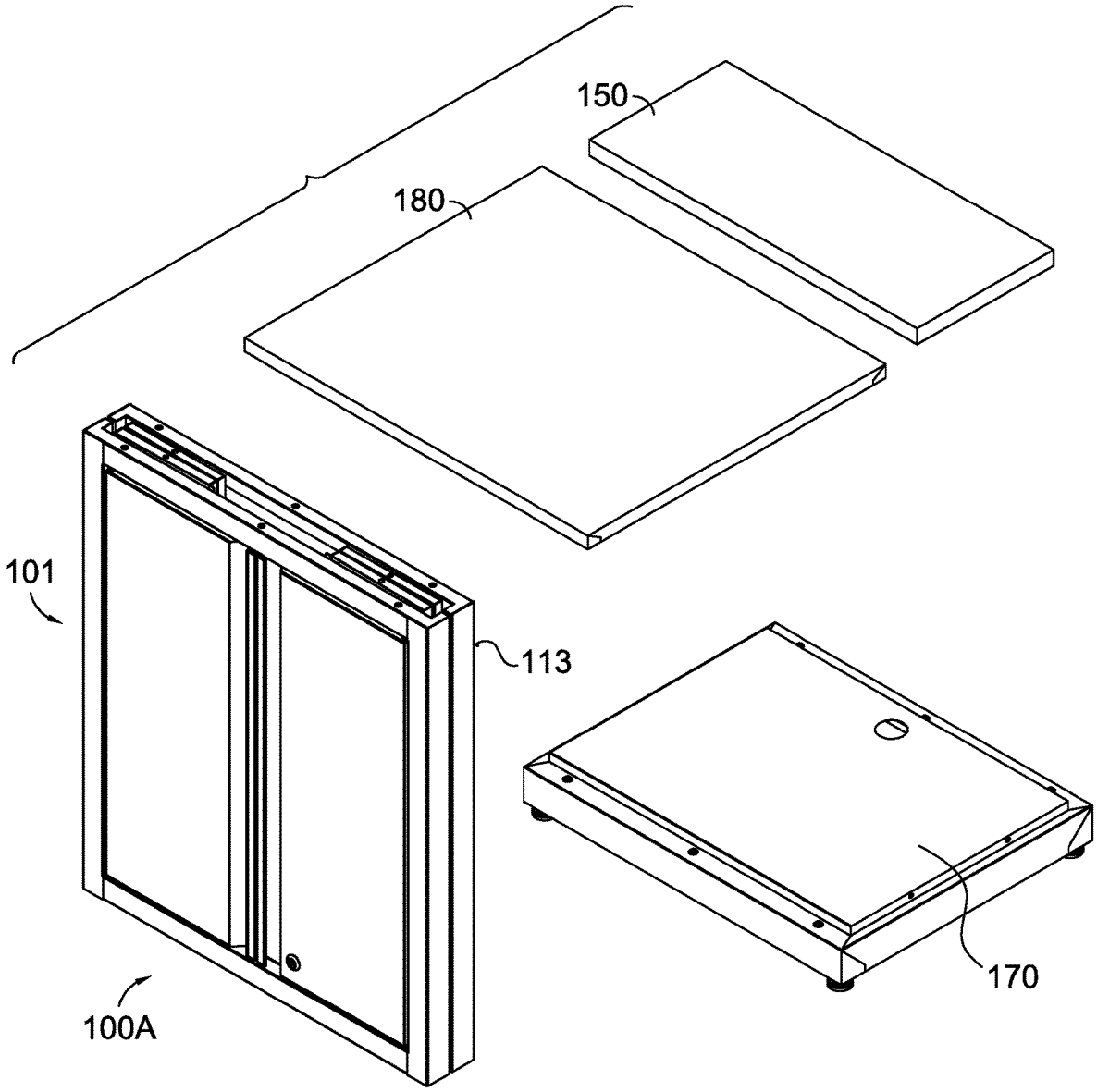
FIG. 14A is a perspective view of another embodiment of a collapsible storage cabinet with a generally flat top.
Figure 14B:
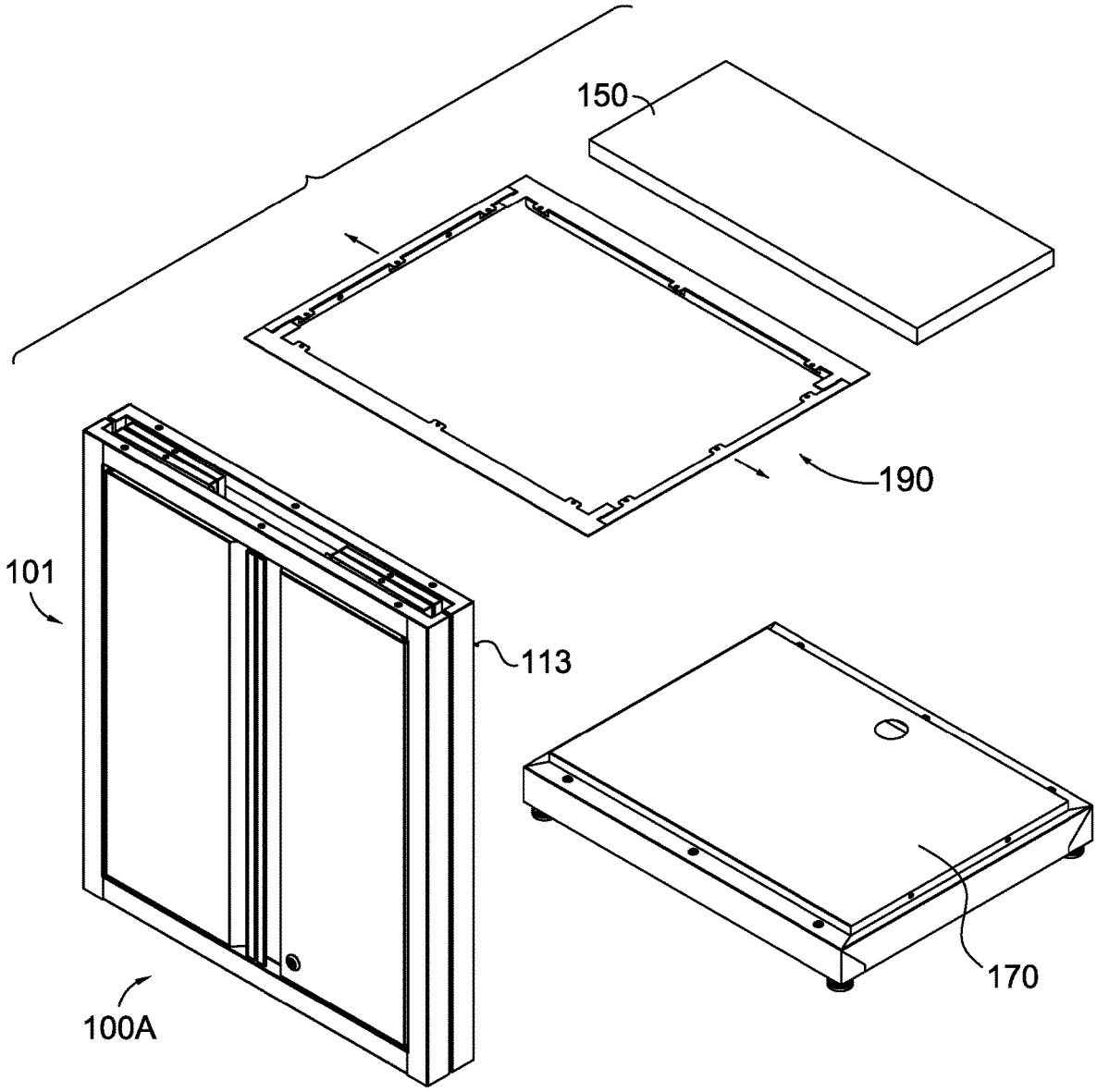
FIG. 14B is a perspective view of another embodiment of a collapsible storage cabinet with a collar.

Turning now to FIGS. 11-13, an alternate method of supporting a shelf in the collapsible storage cabinet 100 is disclosed. To provide increased rigidity to the collapsible storage cabinet 100 when in the fully assembled position, the shelf 150 may be coupled to the hinges 108, one or more panels 110, the sidewalls 106, and/or the back wall 104. With the use of the clips 117 discussed above, the shelf 150 simply sits on the clips 117. However, by replacing the openings 115 and clips 117 with a tongue 154, a more secure connection may be made.

As illustrated in FIG. 11, a tongue 154 may be formed where the opening 115 would otherwise be located. The tongue 154 may be formed by bending a portion of the metal into tongue-like configuration. The tongue 154 defines a space or gap 156 between the tongue 154 and the panel or wall in which it is formed (e.g., hinge 108, sidewall 106, back wall 104, etc.). A bottom portion 158 of the shelf 150 is provided with one or more openings 160. The shelf is placed inside the collapsible storage cabinet 100 when it is in the fully assembled position in a horizontal orientation above the tongues 154. It is then lowered down toward the tongues, wherein a distal end 162 of the tongues 154 are received in the openings 160 in the bottom of the shelf 150. The shelf 150 is lowered until a bottom of the shelf 150 abuts the tongue 154, as illustrated in FIG. 13. A portion of the shelf 150 is pinched between the tongue 154 and the hinge 108 to, in essence, clamp the shelf 150 in place. This makes the shelf 150 more secure, but also ties the panels 110 together and to the shelf, for a more secure arrangement.

Figure 15A:
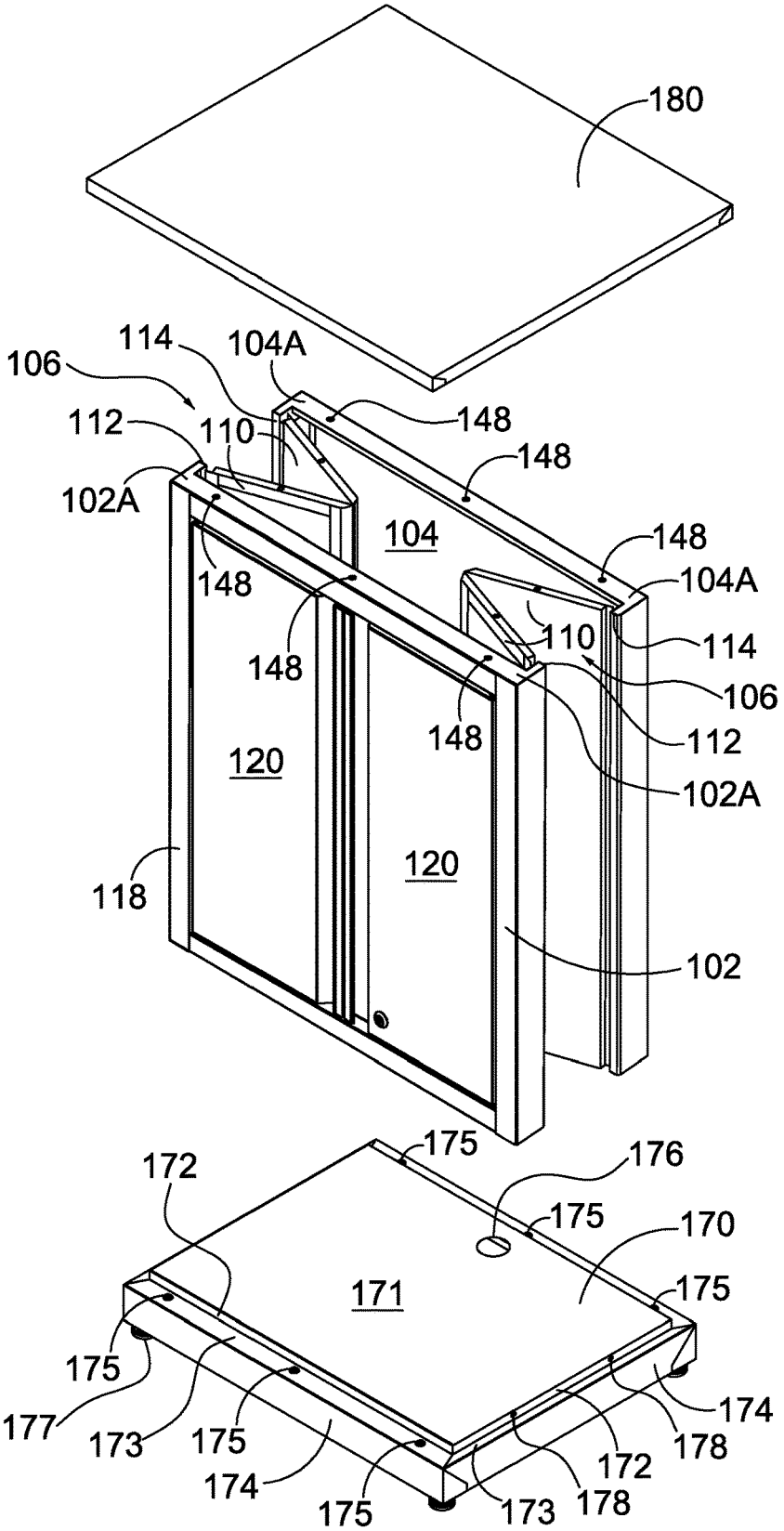
FIG. 15A is a perspective view of the storage cabinet of FIG. 14A in a partially expanded condition.
Figure 16A:
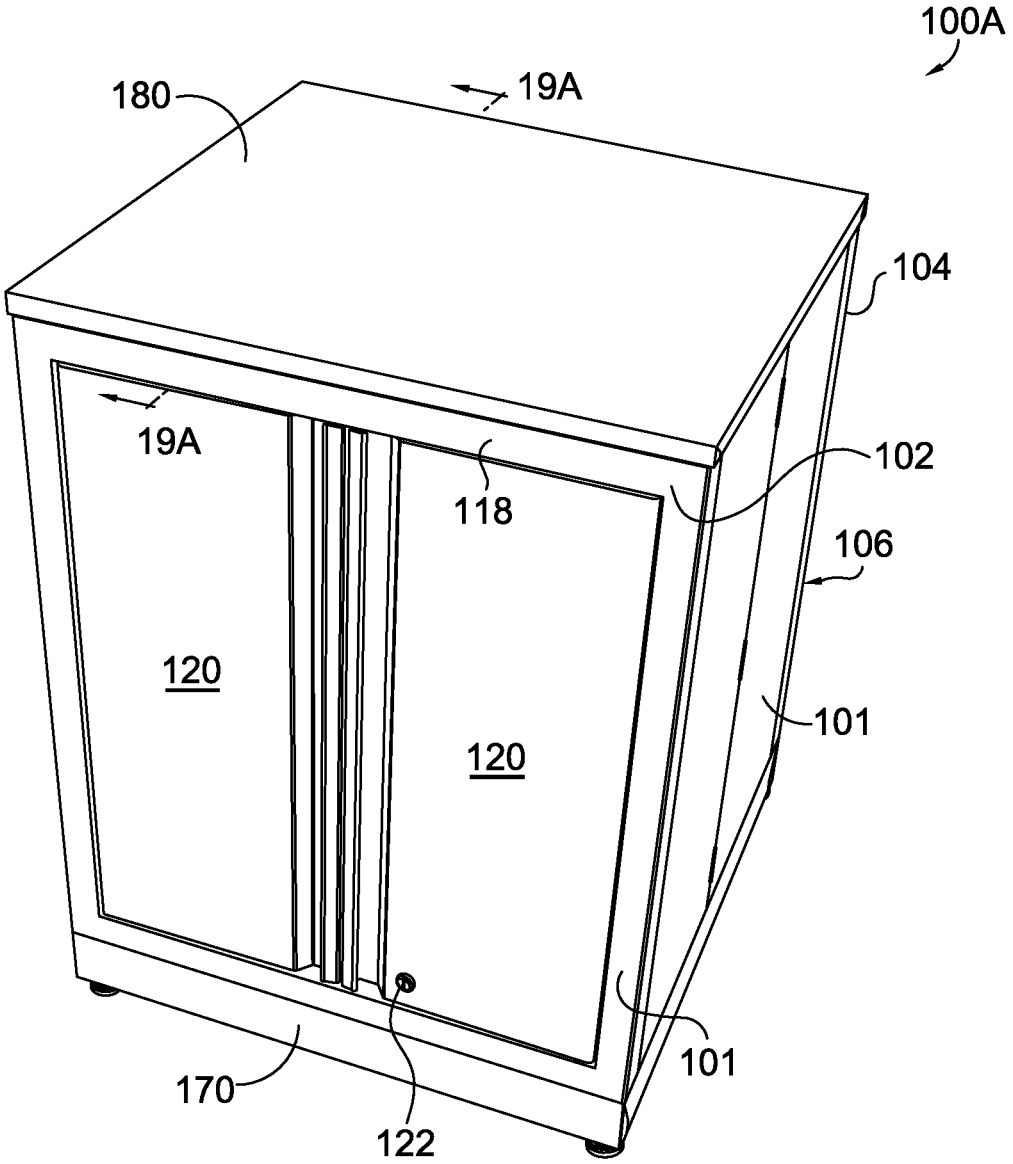
FIG. 16A is a perspective view of the storage cabinet of FIG. 14A in a fully assembled condition.

Referring to FIGS. 14A, 15A, 16A, 17A, and 19A, another embodiment of the storage cabinet 100A is illustrated. This embodiment has a similar collapsible subassembly 101, but includes a top wall 180 and a base or bottom wall 170 in place of, and with different structural features than, the previously described top wall 132 and bottom wall 134. For example, as seen in FIG. 16A, the top wall 180 provides a useful surface for items similar to the top wall 132, but with a generally flat surface, as opposed to the tray-like shape of the top wall 132.

Figure 17A:
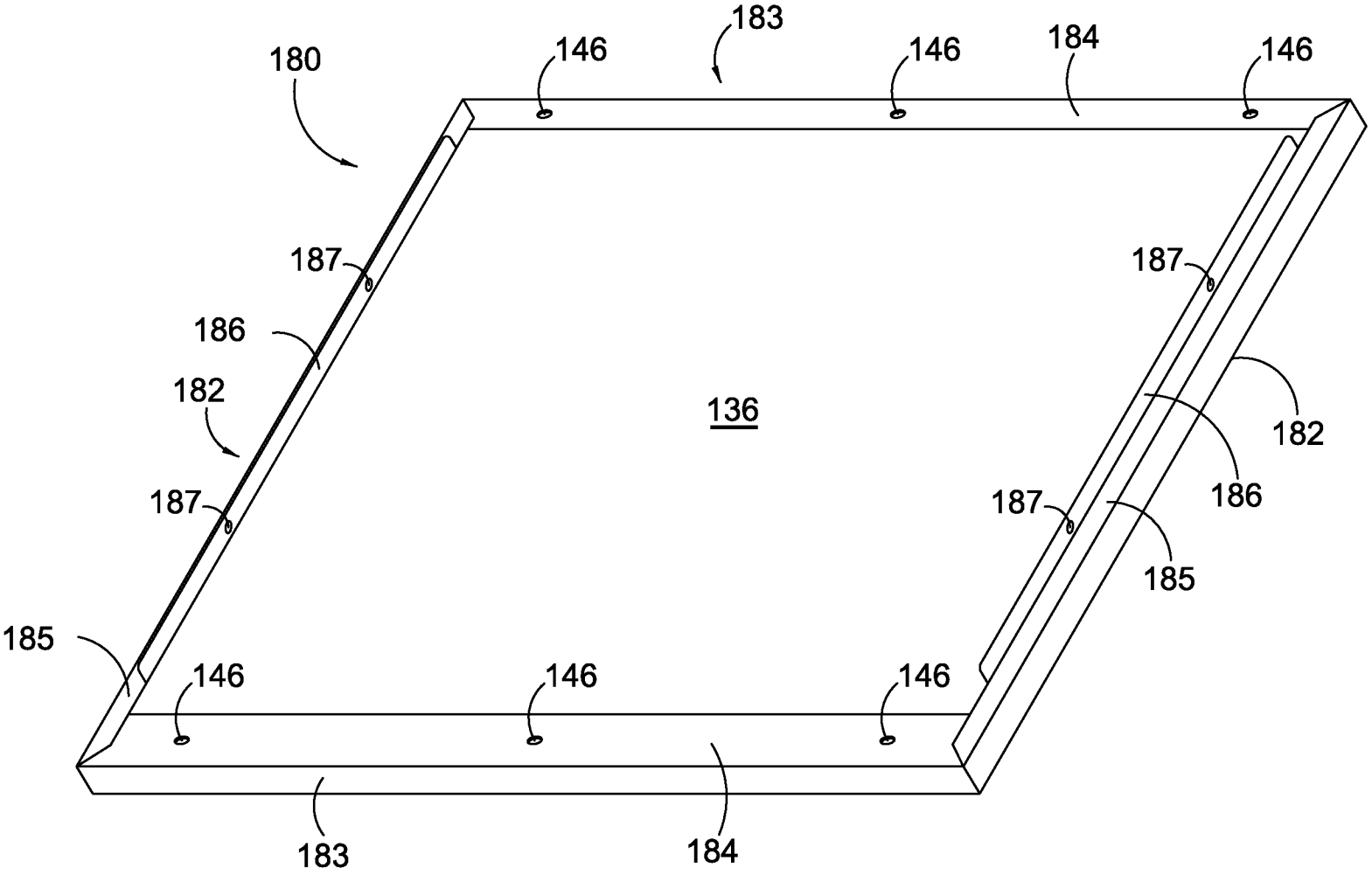
FIG. 17A is a bottom perspective view of a top wall of the storage cabinet of FIG. 14A.

As can be seen in FIGS. 17A, where we are viewing a perspective view of the bottom of the top wall 180, the top wall 180 has a generally planar body 136 that provides a generally flat surface on an upper portion of the top wall 180. The generally planar body 136 of the top wall 180, when positioned in the fully assembled condition illustrated in FIG. 16A, covers a top opening defined by the front wall 102, the back wall 104, and the pair of sidewalls 106. In this way, the generally planar body 136 of the top wall 180 at least partially defines an interior space of the storage cabinet 100A. Referring back to FIG. 17A, the top wall 180 also has a first pair of side walls 182 and a second pair of side walls 183 oriented generally perpendicular to the generally planar body 136 and the upper portion. The first pair of side walls 182 and the second pair of side walls 183 extend downwardly from an upper surface of the top wall 180 to provide a thickness and enhanced structural stability to the top wall 180. In the illustrated embodiment, the top wall 180 is made by bending a piece of sheet metal (e.g., stainless steel) to form the illustrated thickness. The interior of the top wall 180 can be hollow or a solid core (e.g., plywood) for increased strength.

Still referring to FIG. 17A, a portion 185 of the top wall 180 extends between the first pair of side walls 182 and a pair of parallel and opposed downwardly depending flanges 186. The portion 185 of the top wall 180 is in contact with and rests upon the top edges of the pair of sidewalls 106 when the cabinet 100 is in its fully assembled condition. The pair of parallel and opposed downwardly depending flanges 186 are oriented generally perpendicular to the upper portion and generally planar body 136 of the top wall 180. Similar to the first support walls 138 described previously, the pair of parallel and opposed downwardly depending flanges 186 are thereby generally perpendicular to and span between inner portions of the front wall 102 and the back wall 104, providing increased structural rigidity to the collapsible storage cabinet 100, helping to prevent any twisting or lateral movement of the front wall 102 or back wall 104. Furthermore, the pair of parallel and opposed downwardly depending flanges 186 help to prevent collapsing of the folding sidewalls 106. The pair of flanges 186 each contain one or more openings 187 that correspond to respective openings in the sidewalls 106 to aid in securing the top wall 180 to the collapsible subassembly 101 and preventing the collapsing of the folding sidewalls 106. Another portion, portion 184, of the top wall 180 is placed in contact with and secured to the top edges of the front wall 102 and the back wall 104. Somewhat similar to the first and second lips 140 and 144, the portion 184 has one or more openings 146 to aid in securing the top wall 180 to the collapsible subassembly 101. Specifically, the one or more openings 146 of the portion 184 aid in securing the top wall 180 to the front wall 102 and the back wall 104, as shown in FIG. 15A. It should be noted that the flanges 186 with openings 187 or the portion 184 with openings 146 can be used separately, alone, or together with each other as in the illustrated embodiment. And, they can be interchangeable. Further, while openings 187 and 146 are provided to permit fasteners to secure the top wall 180 to the collapsible subassembly 101, the openings 187 and 146 can be omitted and fasteners not used.

Figure 15B:
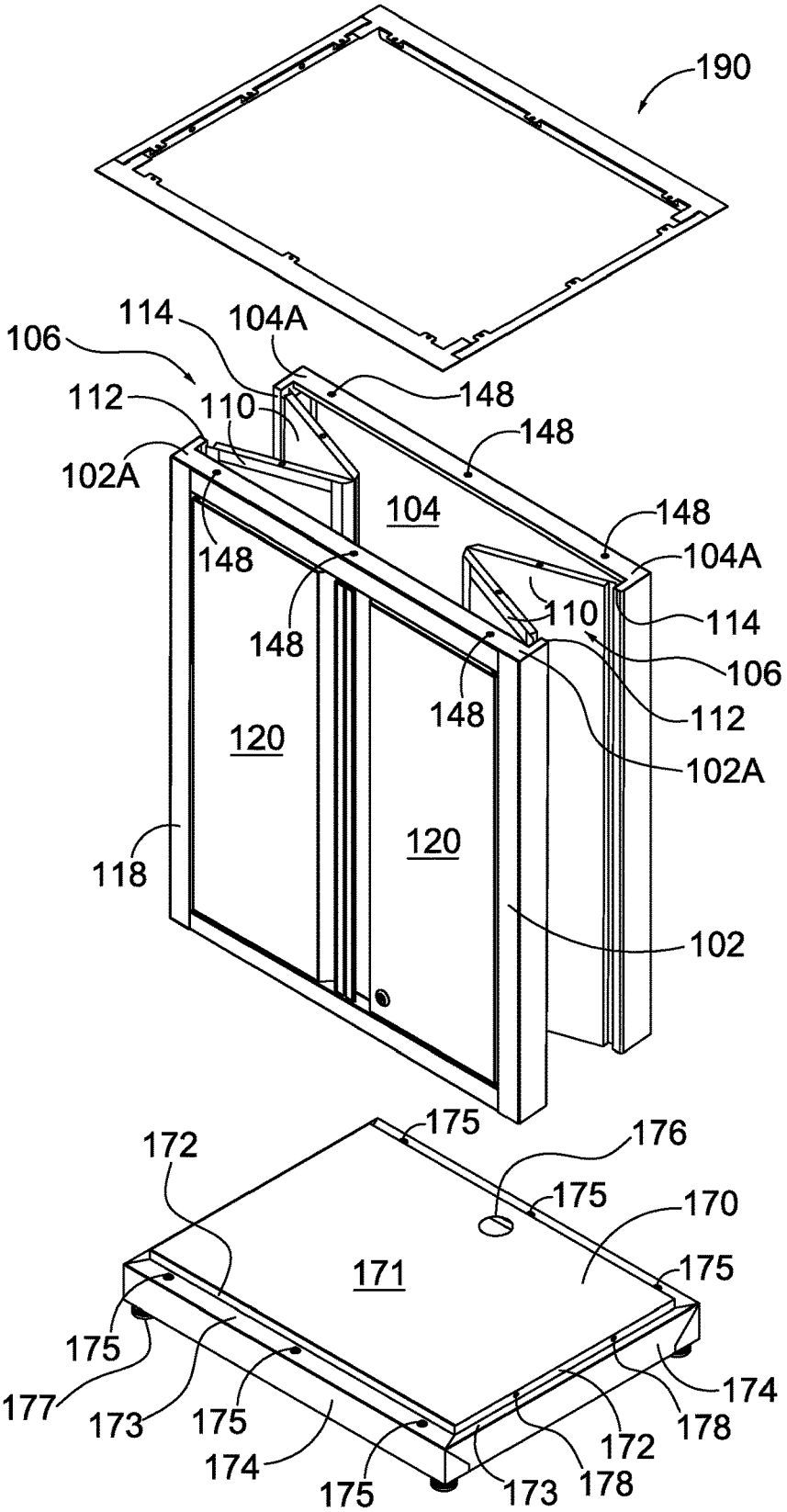
FIG. 15B is a perspective view of the storage cabinet of FIG. 14B in a partially expanded condition.
Figure 16B:
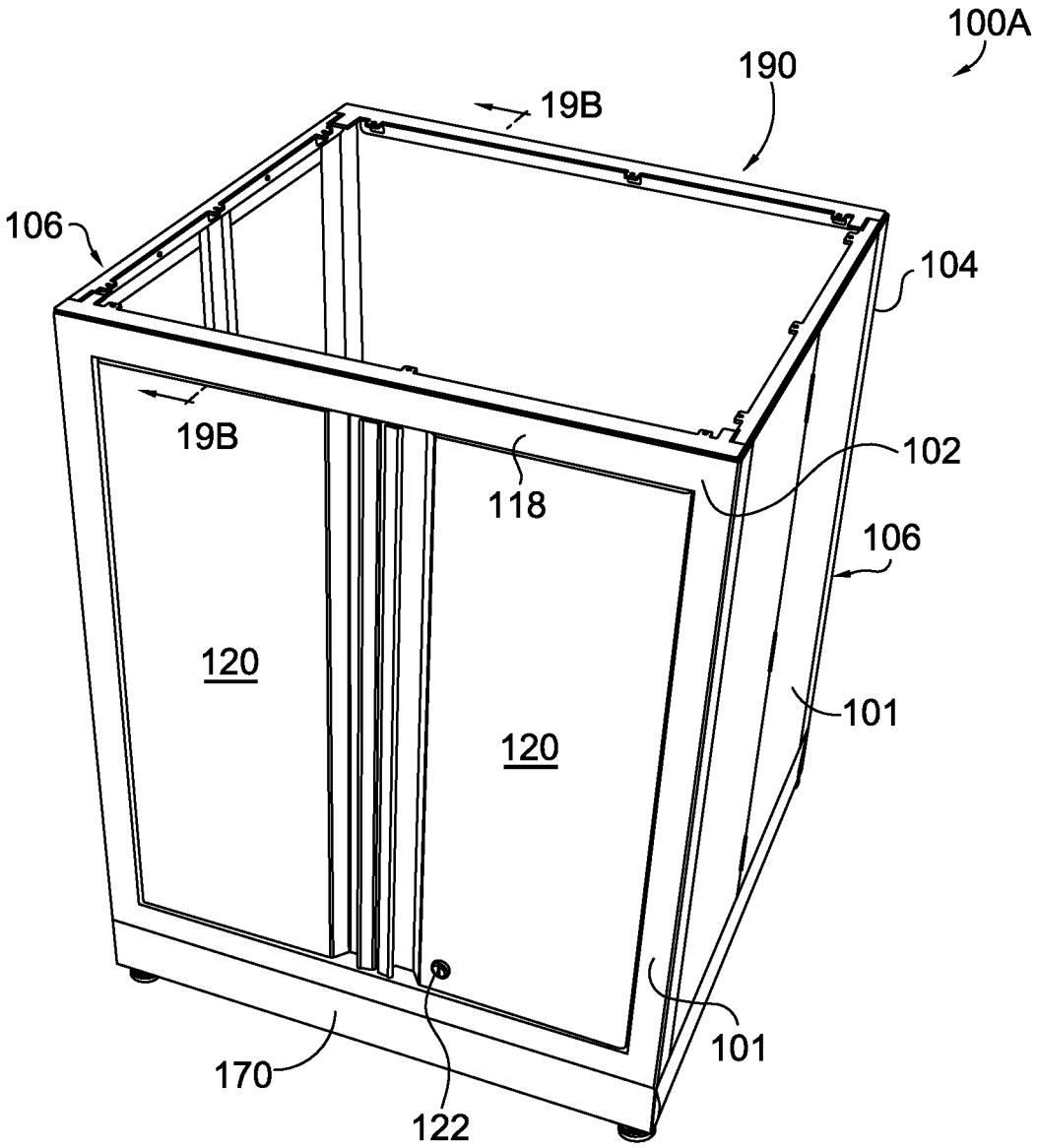
FIG. 16B is a perspective view of the storage cabinet of FIG. 14B in a fully assembled condition.
Figure 17B:
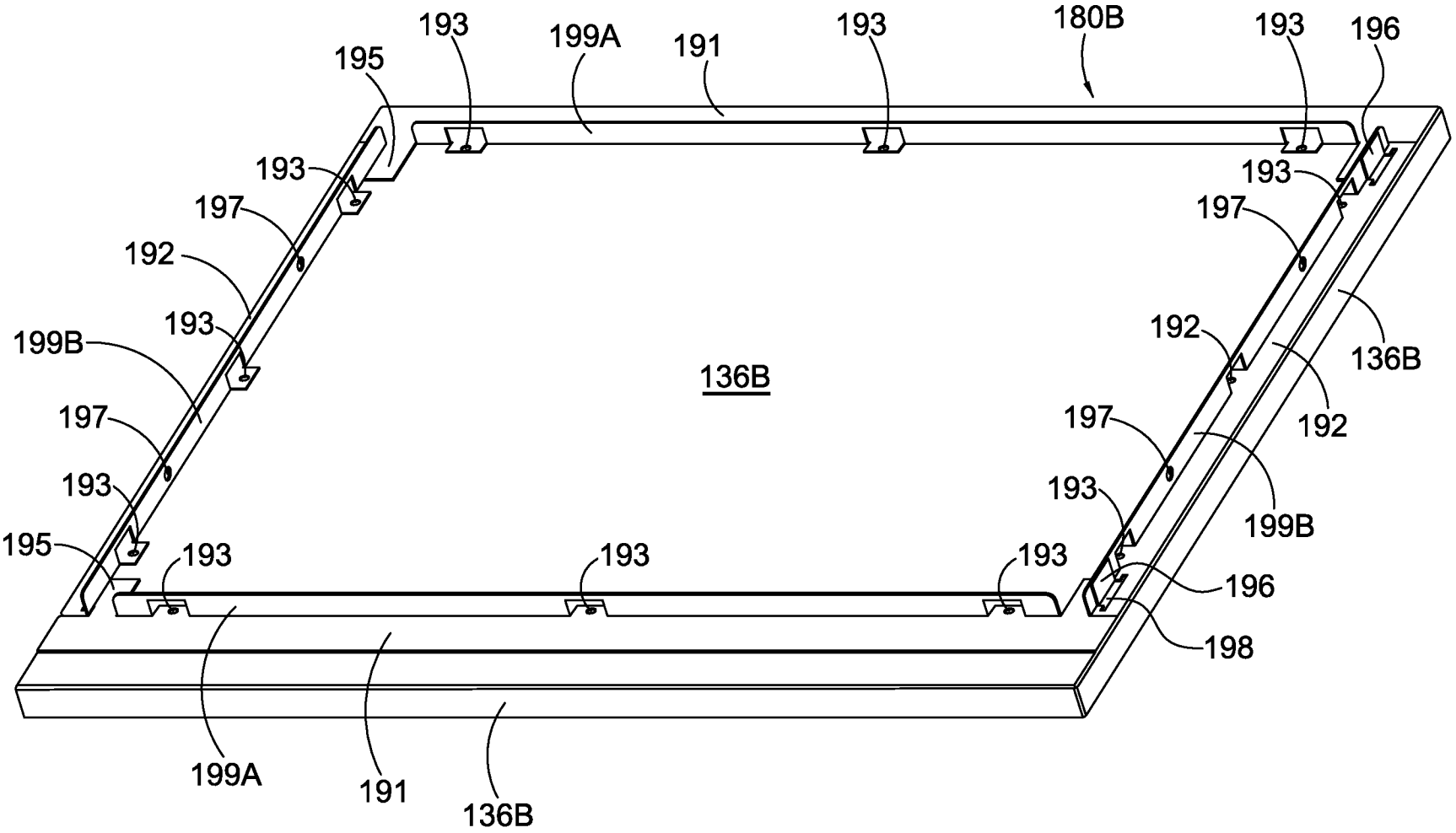
FIG. 17B is a bottom perspective view of an alternate embodiment of a top wall of the storage cabinet of FIG. 14A.

Referring to FIGS. 14B, 15B, 16B, 17B, 18A, 18B, and 19B, the embodiment of the storage cabinet 100A is illustrated; however, this one includes a solid surface attachment collar 190 with different structural features than the previously described top wall 132 or top wall 180. For example, as seen in FIG. 16B, the collar 190 may be attached to the upper surface of the collapsible subassembly 101, while also being attached, as illustrated in FIG. 17B, to a solid surface 136B, such as a granite countertop. In this manner, the collar facilitates attaching solid surface materials to the collapsible subassembly 101, while also preventing the collapsing of the collapsible subassembly 101.

Figure 18A:
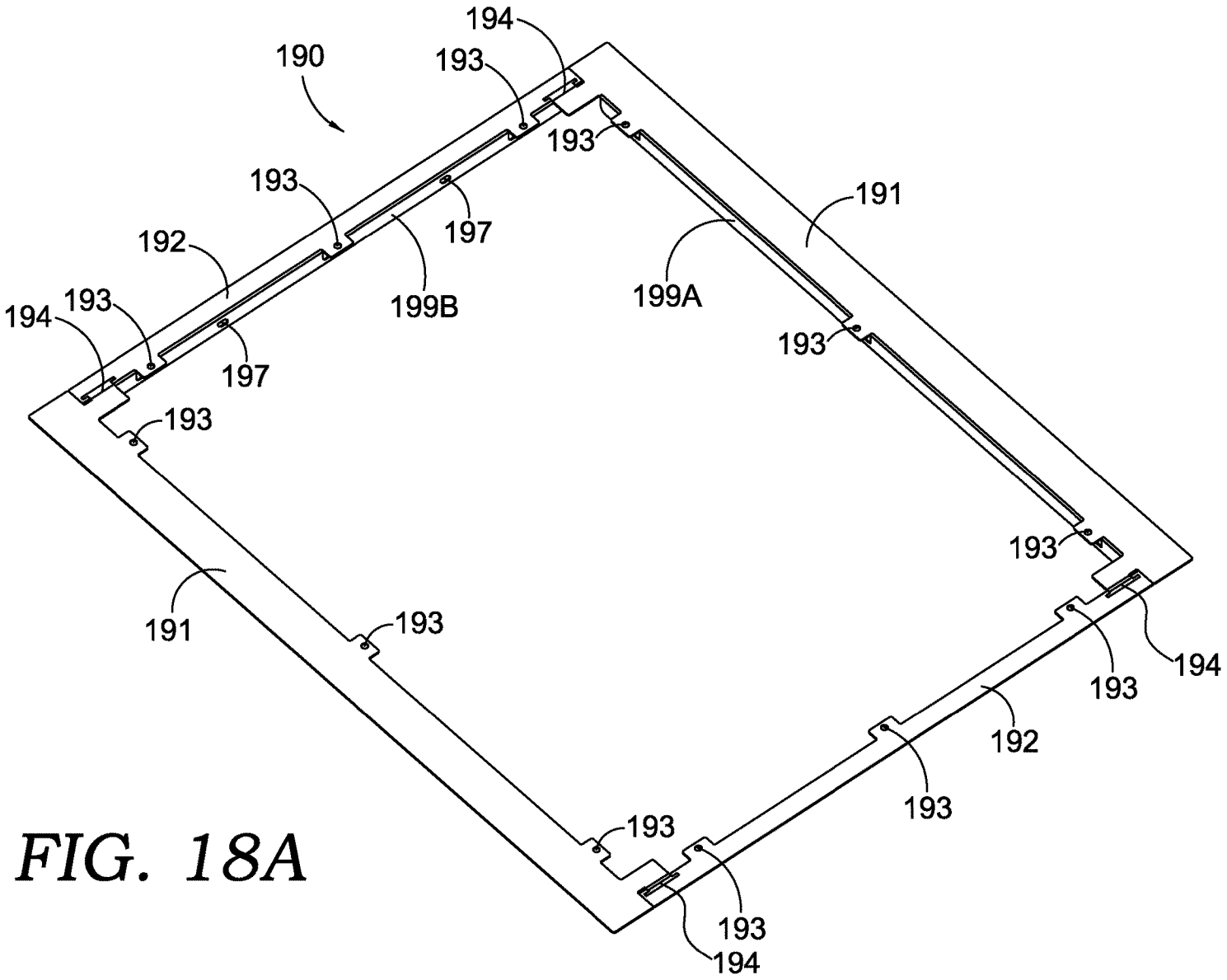
FIG. 18A is a bottom perspective view of a collar of the storage cabinet of FIG. 14B.
Figure 18B:
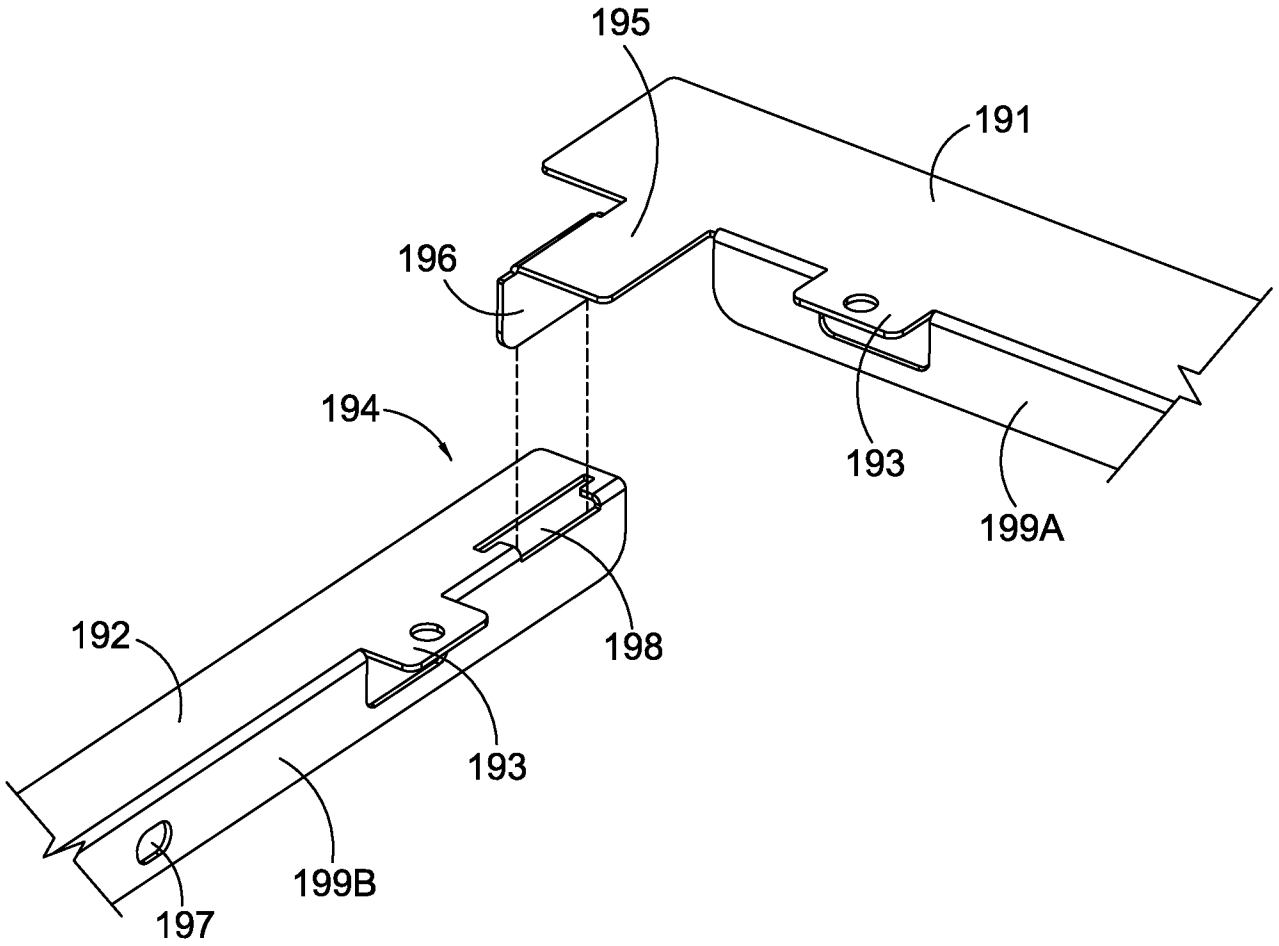
FIG. 18B is a fragmentary exploded view illustrating portions of the collar of FIG. 18A and depicting a connection between one of a first pair of collar members and one of a second pair of collar members.

As can be seen in FIGS. 18A and 18B, the collar 190 may be comprised of multiple individual members; however, the collar 190 could also be formed unitarily and attached to the collapsible subassembly 101. The collar 190 includes a first pair of collar members 191 and a second pair of collar members 192, each member of the first pair of collar members 191 and the second pair of collar members 192 having a generally planar body. As shown in FIG. 18A, the first pair of collar members 191 and the second pair of collar members 192 may be coupled to each other at one or more attachment sites 194 located adjacent the ends of both the first pair of collar members 191 and the second pair of collar members 192. The one or more attachment sites 194 help to maintain a positioning of the collar 190 relative to its collar members 191 and 192, as well as to the collapsible assembly 101. The collar 190 is removably securable to the front wall 102, the back wall 104, and the sidewalls 106, as depicted in the fully assembled condition of the collapsible storage cabinet in FIG. 16B. Still referring to FIG. 16B, when secured to the collapsible assembly 101, the collar 190 helps to at least partially define a top opening of the collapsible storage cabinet 100. While the illustrated embodiment includes both the first pair of collar members 191 and the second pair of collar members 192 and they are used together, either of the first pair of collar members 191 or the second pair of collar members 192 may be used separately or omitted.

Referring back to FIG. 18A, the first pair of collar members 191 each include a downwardly depending flange 199A oriented generally perpendicular to the generally planar body of the first pair of collar members 191 and which extend within the top opening adjacent one of the front wall 102 and the back wall 104. The second pair of collar members 192 each include a downwardly depending flange 199B oriented generally perpendicular to the generally planar body of the second pair of collar members 192 and which extend within the top opening. The flanges 199B of the second pair of collar members extend within the top opening and help prevent the sidewalls 106 from folding in. The flanges 199B have one or more openings 197 that correspond with openings in the sidewalls 106. Additionally, the flanges 199A and the flanges 199B, in the illustrated embodiment, have one or more connection tabs 193 extending from, and generally parallel to, the generally planar body of the first pair of collar members 191 and the second pair of collar members 192. The connection tabs 193 have one or more openings to help facilitate the securement of a solid surface top 136B to the collar 190 and, in turn, to the collapsible assembly 101. The flanges 199A and the flanges 199B in the illustrated embodiment are adjacent, but not in contact, with each other. The connection tabs 193 can be omitted in other embodiments. Further, instead of connecting the collar 190 with the solid surface top 136B via fasteners through the openings in the connection tabs, the collar 190 may be connected to the solid surface top 136B by placing an adhesive or silicon there between. Similarly, instead of connecting, securing, or otherwise coupling the collar 190 (or the top wall 180) to the collapsible subassembly 101 with fasteners, an adhesive or silicon may be used or the collar 190 can simply be placed in place and held there by a friction fit or the weight of the top wall.

FIG. 18B shows an enlarged, fragmentary, exploded view of an attachment site 194 between a collar member of the first pair of collar members 191 and a collar member of the second pair of collar members 192. The first pair of collar members 191 each have a horizontal extension 195 adjacent both ends of their generally planar bodies. Additionally, each horizontal extension 195 of the first pair of collar members 191 has an insertion tab 196 extending from the horizontal extension 195 and oriented generally perpendicular to the horizontal extension 195. The second pair of collar members 192 each have a slot opening 198 adjacent both ends of their generally planar bodies that corresponds to and receives one of the insertions tabs 196 of the first pair of collar members 191. In order to secure the first pair of collar members 191 with the second pair of collar members 192 to form the collar 190, the insertions tabs 196 are positioned within the slot openings 198, as illustrated in FIG. 18A.

Referring now back to FIG. 17B, a top wall 180B has a generally planar body 136B that provides a generally flat surface on an upper portion of the top wall 180B. In this embodiment, the generally planar body 136B is a solid surface, such as a slab of granite for use as a countertop on top of the cabinet 100. Other materials that can be used as a countertop, such as quartz, concrete, wood, and the like may also be used and attached to the cabinet 100 via the collar 190.

The flanges 199A and 199B of the collar 190 extend away from the generally planar body 136B of the top wall 180B and, when fully assembled, extend down into a top opening defined by the front wall 102, the back wall 104, and the pair of sidewalls 106, as seen in FIG. 16B where the generally planar body 136B is omitted. In this way, the generally planar body 136B of the top wall 180B at least partially defines an upper boundary of the interior space of the storage cabinet 100.

In the illustrated embodiment, when assembled, a portion of a rearward most collar member 191 rests on a top edge of the back wall 104 and a portion of a forward most collar member 191 rests on a top of the front wall 102. Similarly, a portion of each of the second pair of collar members 192 rests on a top portion of one of the pair of sidewalls 106. The second pair of collar members 192 are then coupled with the sidewalls 106 by fasteners (illustrated in FIG. 19B) received in the openings 197 in the flanges 199B. The flanges 199B not only provide a coupling means for the collar 190, but also provide increased structural rigidity to the collapsible storage cabinet 100 and help to prevent twisting or lateral movement of the front wall 102 or back wall 104. Furthermore, the flanges 199B help to prevent collapsing of the folding sidewalls 106 and aid in securing the top wall 180B to the collapsible subassembly 101. It should be understood that the second pair of collar members 192 do not have to be coupled to the sidewalls 106 with fasteners received in the openings 197 in the flanges 199B and the flanges can still help prevent collapsing of the collapsible subassembly 101 of the collapsible storage cabinet 100.

Figure 19A:
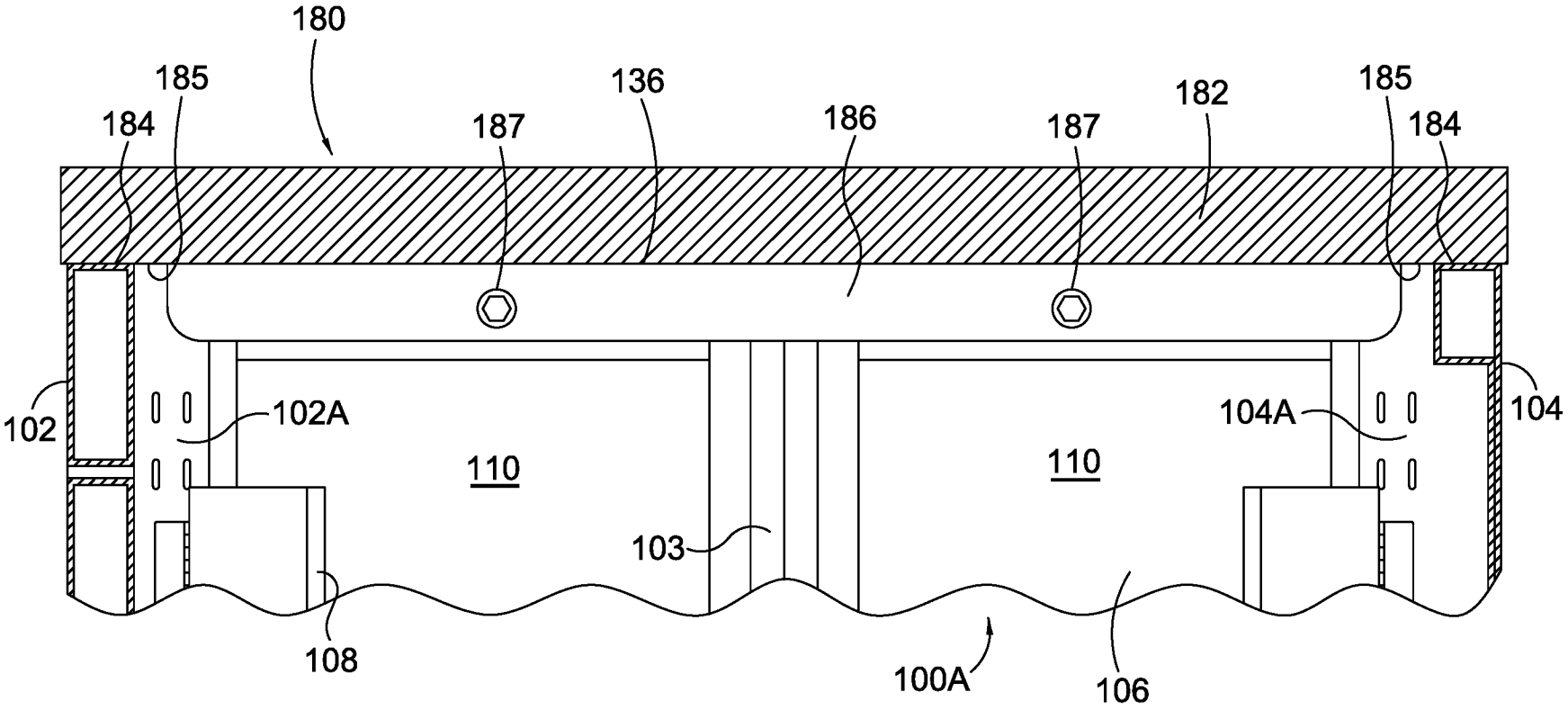
FIG. 19A is a fragmentary cross-sectional view of a portion of the storage cabinet of FIG. 16A taken along the line 19A-19A.
Figure 19B:
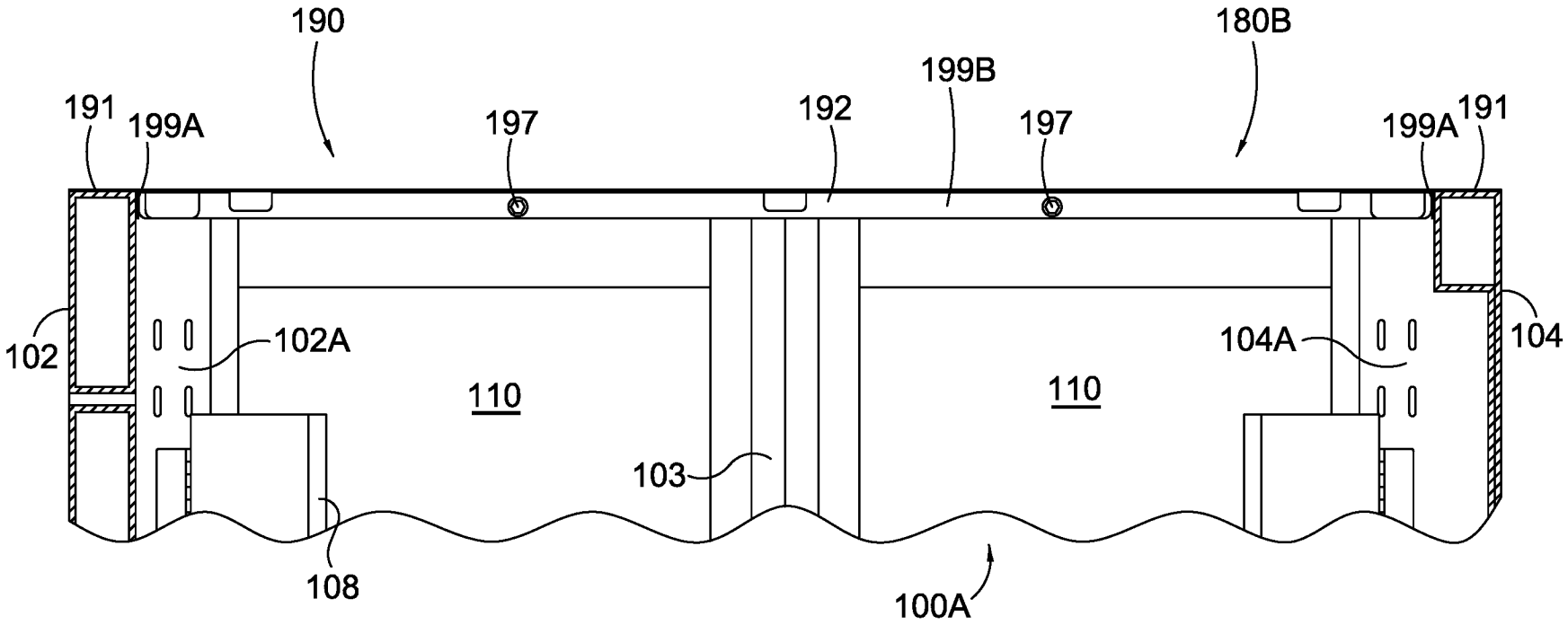
FIG. 19B is a fragmentary cross-sectional view of a portion of the storage cabinet of FIG. 16B taken along the line of 19B-19B.

The design of the top wall 180 and 180B also provides increased structural stability for the storage cabinet 100. Referring to FIGS. 19A and 19B, fragmentary cross-sectional views of the storage cabinet 100 depicting both embodiments of the top wall 180 and 180B are shown (the solid surface 136B of top wall 180B is omitted in FIG. 19B for clarity). In FIG. 19A, the cross-sectional view of the storage cabinet 100 shows the generally planar body 136 of the top wall 180, one of the pair of parallel and downwardly depending flanges 186, the portion 184 and the portion 185, and the one or more openings 187. FIG. 19A illustrates how the pair of parallel and downwardly depending flanges 186 are positioned to provide increased structural rigidity to the collapsible storage cabinet 100 and help prevent the collapsing of the plurality of panels 110 forming the collapsible sidewalls 106. The portions 184 are shown being secured to, and in contact with, the top edge of the front wall 102 and the top edge of the back wall 104. The one or more openings 187 are shown with fasteners therein for securing the top wall 180 to the sidewalls 106.

The design of the collar 190 also provides increased structural stability for the storage cabinet 100. Referring to FIG. 19B, a fragmentary, cross-sectional view of the storage cabinet 100 with collar 190 is shown. The partial cross-sectional view of the storage cabinet 100 shows the first pair of collar members 191, one member of the second pair of collar members 192, the flanges 199A downwardly depending from the first pair of collar members 191, and the one or more openings 197 of the second pair of collar members 192. The one or more openings 197 are shown with fasteners therein to secure the collar 190 to the sidewalls 106 and to prevent the sidewalls 106 from folding in. FIG. 19B also illustrates how the flanges 199B are positioned to provide increased structural rigidity to the collapsible cabinet 100 and help prevent the collapsing of the plurality of panels 110 forming the collapsible sidewalls 106. The first pair of collar members 191 are positioned above, and in contact with, top edges of the front wall 102 and the back wall 104.

Referring now back to FIGS. 15A and 15B, embodiments of the storage cabinet 100 are illustrated comprising a bottom wall or base 170 with different structural features than the previously described bottom wall 134. The bottom wall 170 has a generally planar body 171 that provides a generally flat surface for storing items thereupon. The generally planar body 171 extends between bottom edges of the front wall 102, the back wall 104, and the sidewalls 106. Further, the generally planar body 171 is positioned intermediate and recessed above the bottom edges of the front wall 102, the back wall 104, and the sidewalls 106. A first plurality of support walls 172 extend downwardly from the generally planar body 171 and are oriented generally perpendicular to the generally planar body 171. The first plurality of support walls 172 extending from the generally planar body 171 help to prevent the sidewalls from folding. The first plurality of support walls 172 have one or more openings 178 corresponding to openings on an interiorly facing side of the sidewalls 106. Fasteners (not shown) are positioned in the one or more openings 178 to secure the bottom wall 170 to the sidewalls 106 and help prevent the sidewalls 106 from folding in. Each of the first plurality of support walls 172 transitions to a lip 173 which may include one or more openings 175 corresponding to openings in the bottom edges of the front wall 102, the back wall 104, and/or the sidewalls 106. The lips 173 are oriented generally parallel to the generally planar body 171. A second plurality of support walls 174 extend downwardly from the lips 173 of each of the first plurality of support walls 172 and are oriented generally perpendicular to the generally planar body 171. Attached to a bottom of the second plurality of support walls 174 are one or more leveling feet 177 to aid in providing a stable storage cabinet 100 that won't tilt or fall over. Also included in the bottom wall 170 is an aperture 176 that can provide access to the interior of the cabinet 100 for plumbing, wiring, etc., as desired by a user.

Figure 20:
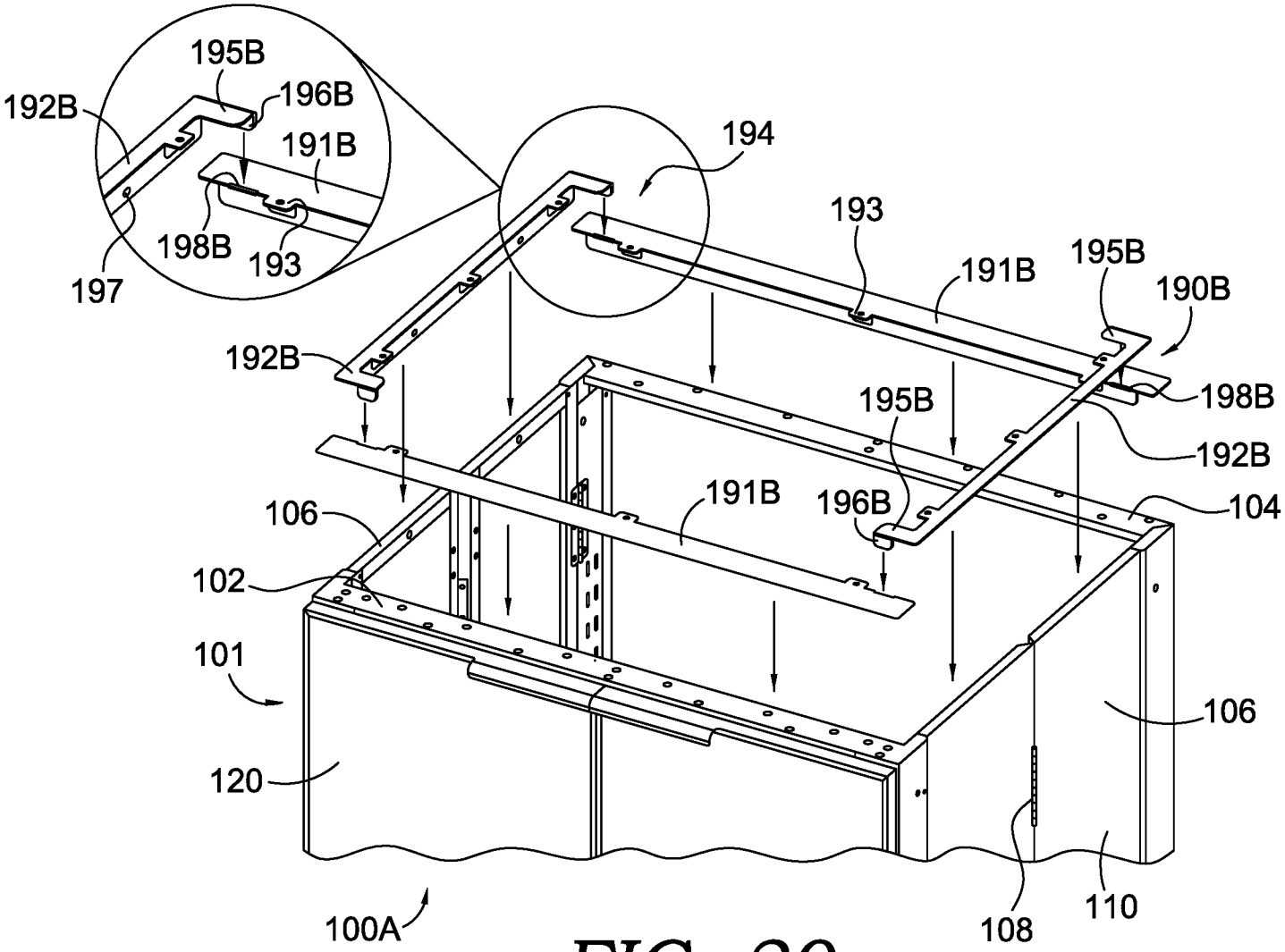
FIG. 20 is fragmentary perspective view of the storage cabinet of FIG. 16B with an alternate embodiment of a collar in an exploded view and with an enlarged area.

FIG. 20 illustrates an alternate embodiment of a collar 190B in an exploded perspective view. This embodiment still includes a first pair of collar members 191B, for positioning along the front and back walls 102, 104, and a second pair of collar members 192B, for positioning along the sidewalls 106. The collar members 191B and 192 still have the connection tabs 193 and the second pair of collar members 192B still have one or more openings 197 that correspond with openings in the sidewalls 106. However, in this embodiment, the first pair of collar members 191B have the slot openings 198B adjacent their ends for coupling with the second pair of collar members 192B by receipt of insertion tabs 196B located the ends of the second pair of collar members 192B in the slot openings 198B. The insertion tabs 196B extend downwardly from horizontal extensions 195B. This embodiment illustrates that the connection components of the collar members may be moved among the collar members and still be within the scope of the present invention.

Figure 21:
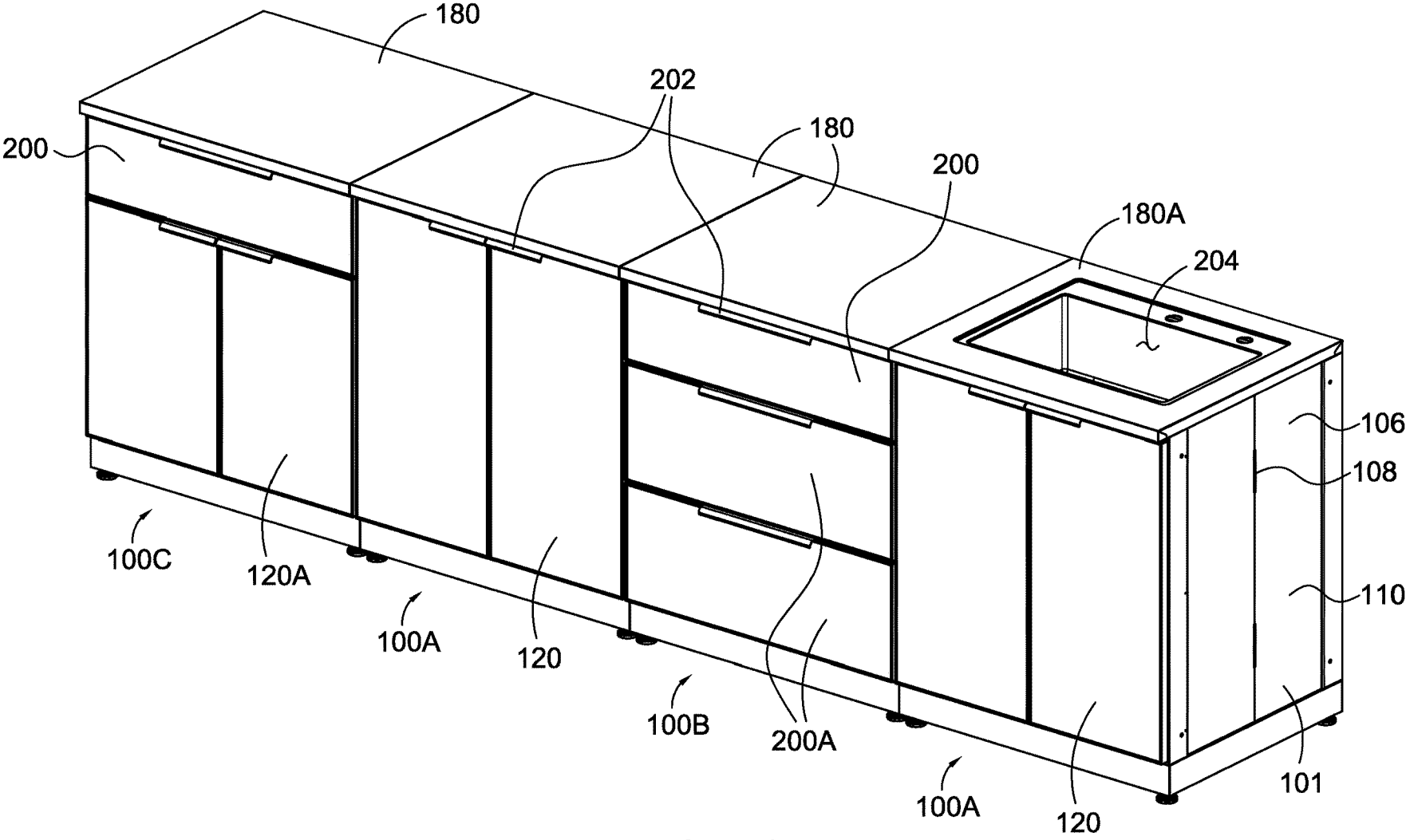
FIG. 21 is a perspective view of a plurality of collapsible storage cabinets of various embodiments in accordance with the present invention.

FIG. 21 illustrates two other alternate embodiments of a storage cabinet 100B and 100C. These embodiments use the same or a similar collapsible subassembly 101, but instead of only doors 120 on the front wall 102, they are provided with one or more collapsible drawers 200. The drawers 200 can be of varying depths, as seen by drawers 200 and 200A. The drawers 200, 200A may have handles 202 that are similar to the handles 202 of the doors 120, 120A.

In the illustrated embodiment, the storage cabinet 100B could be shipped with the collapsible subassembly 101, the top wall 180, the drawer 200, and two drawers 200A. It would not be shipped with a shelf 150. Similarly, the storage cabinet 100C could be shipped with the collapsible subassembly 101, the top wall 180, the drawer 200, and two smaller doors 120A. It would also likely include a shelf 150 for insertion in the area behind the doors 120A. Alternatively, instead of being shipped with top wall 180, the storage cabinets 100B and 100C could be shipped with either solid surface attachment collar 190 or 190B. In other instances, the collapsible subassembly 101 could be sold separately and a purchaser could buy any desired configuration of drawers and/or doors and/or tops/collars separately depending on the configuration they desire. Similarly, the tops or collars could be sold separately and the collapsible subassembly 101 could be packaged with door/drawer/shelf combinations.

The rightmost storage cabinet 100A in FIG. 21 includes an alternate embodiment of a top wall 180A. The top wall 180A includes an opening 204 there through. In instances where the storage cabinets 100, 100A-C are used to make an outdoor kitchen, the opening 204 in the top wall 180A may receive a sink (not pictured). A flange of the sink may rest upon an upper surface of the top wall 180A. Alternatively, the top wall 180A could have the sink formed into the top wall 180A. The top wall 180A could be sold with or separate from the collapsible subassembly 101.

Figure 22:
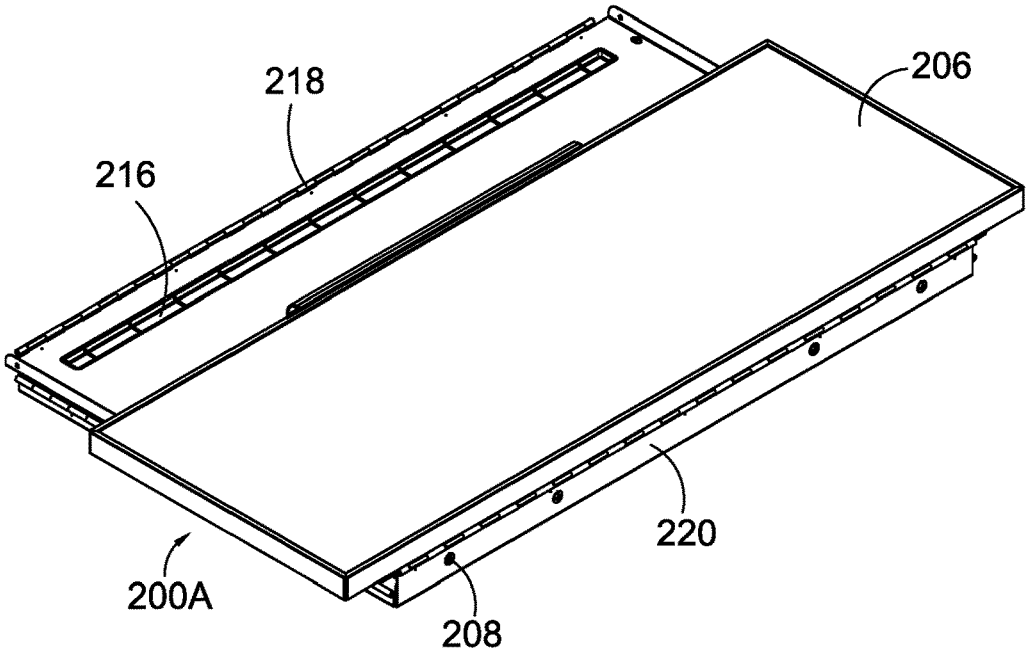
FIG. 22 is a perspective view of a collapsible drawer in accordance with an embodiment of the present invention in a collapsed position.
Figure 23:
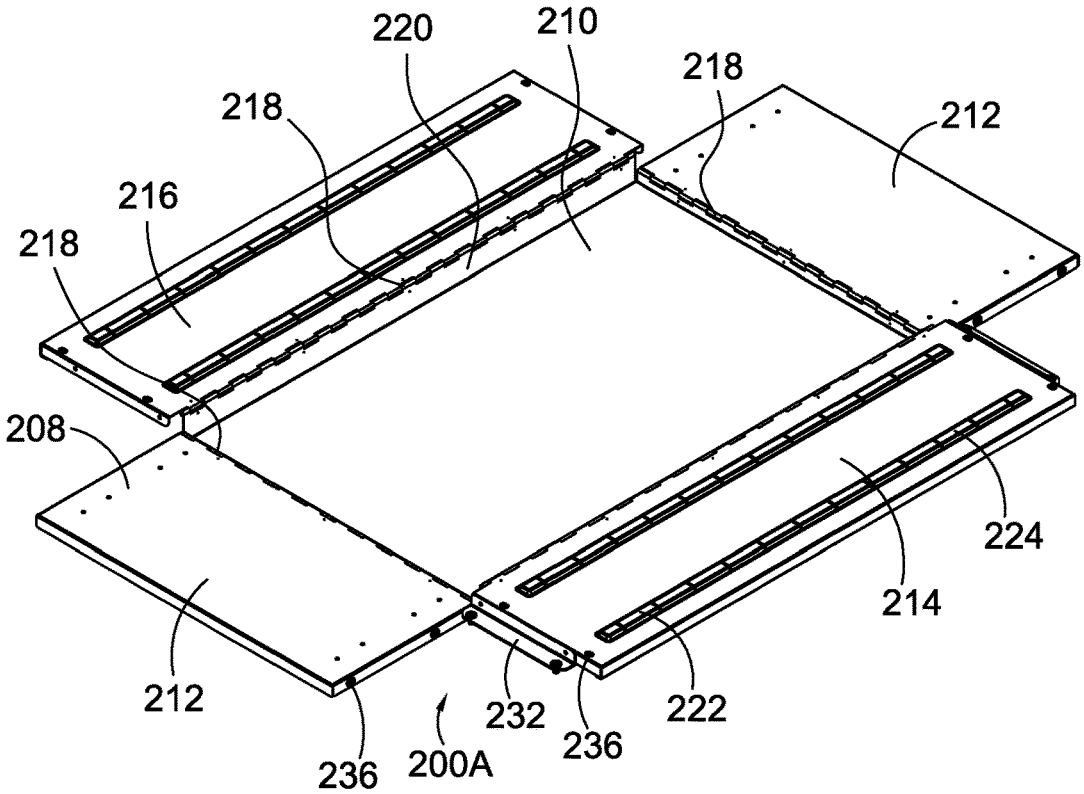
FIG. 23 is a perspective view of a drawer body of the collapsible drawer of FIG. 22 in an open position.

FIG. 22 illustrates a perspective view of a collapsible drawer 200A in a collapsed and folded up state for packaging and shipping. The drawer 200A includes a drawer front 206 and a drawer body 208. FIG. 23 illustrates the drawer body 208 of FIG. 22 in an open configuration. The drawer body 208 includes a drawer bottom 210, drawer sides 212, a drawer front wall 214, and a drawer back wall 216. The drawer sides 212, drawer front wall 214, and drawer back wall 216 are connected to the drawer bottom 210 by one or more hinges 218. In the illustrated embodiment, the hinges 218 are piano hinges that run the length of the drawer sides 212, drawer front wall 214, and drawer back wall 216. The piano hinges could be replaced with multiple hinges.

As illustrated in FIG. 23, the drawer sides 212 have a thickness that is generally the same as a thickness of the drawer bottom 210 and they are connected to the drawer bottom 210 by the hinges 218 in a manner that allows the drawer sides 212 to be generally coplanar with the drawer bottom 210 when the drawer sides 212 are folded out to the open configuration illustrated. For packing and shipping, the drawer sides 212 may be folded in onto a top of the drawer bottom 210 so they rest thereon.

Figure 24:
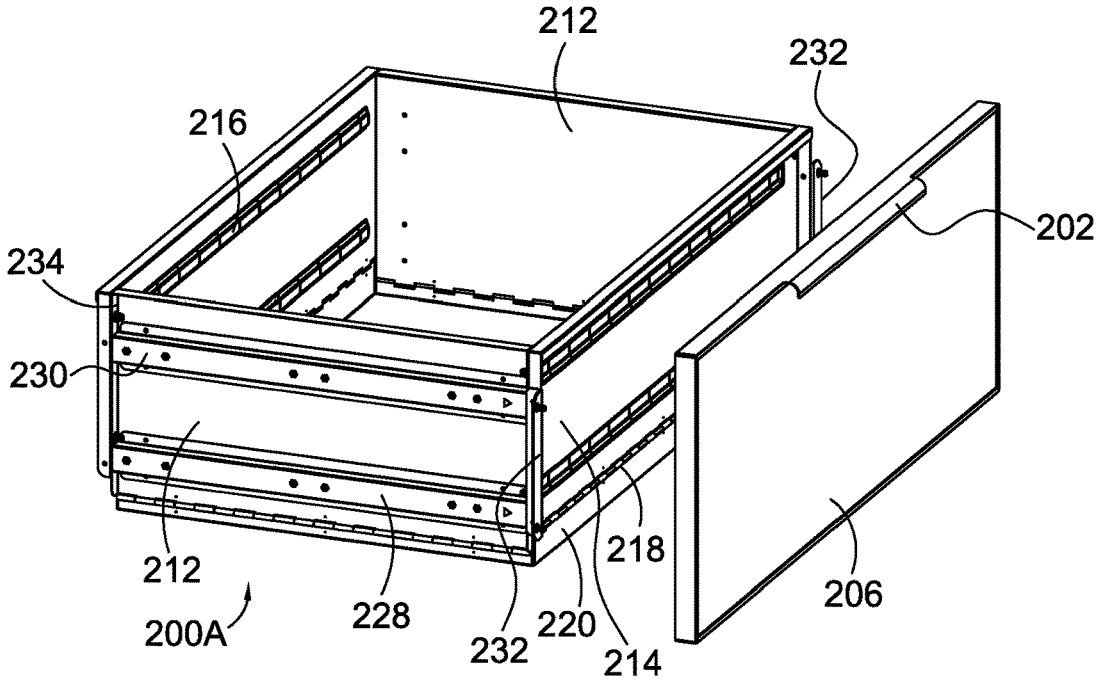
FIG. 24 is a perspective view of the drawer body of FIG. 23 in an assembled position with a drawer front about to be mounted thereto.

Short walls 220 are provided along front and rear edges of the drawer bottom 210, as best seen in FIGS. 22 and 24. The drawer front wall 214 and drawer back wall 216 are connected to the short walls 220 by the hinges 218. The short walls 220 raise the hinge point of the drawer front wall 214 and drawer back wall 216 above the drawer bottom 210 so that the drawer front wall 214 and drawer back wall 216 may lay flat on top of the drawer sides 212 when they are folded in onto a top of the drawer bottom 210, as illustrated in FIG. 22.

Figure 25:
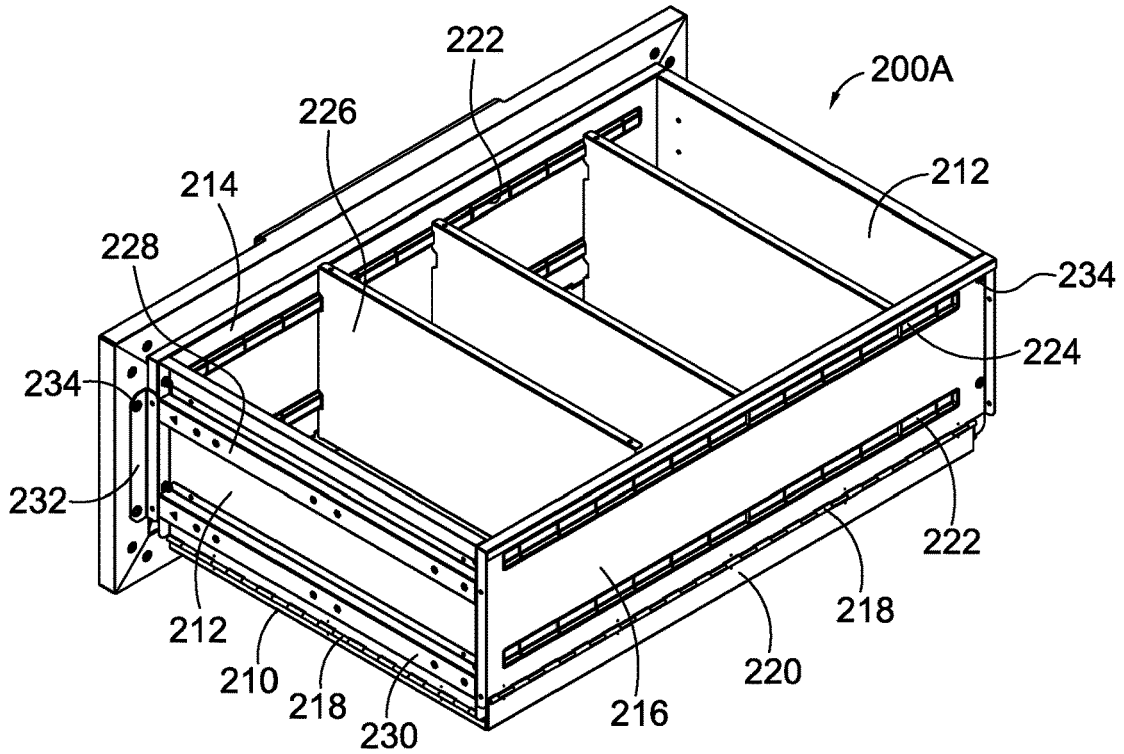
FIG. 25 is a rear perspective view of the drawer body of FIG. 24 with the drawer front coupled therewith and a plurality of dividers received in the collapsible drawer.

The drawer front wall 214 and drawer back wall 216 may include one or more ribs 222 with slots 224 therein. Dividers 226 may be placed in the slots 224 to partition the drawer 200, 200A. The ribs 222 also provide increased structural rigidity to the drawer front wall 214 and drawer back wall 216. Similarly, the drawer sides 212 may be provided with channels 228, as seen in FIGS. 24 and 25. The channels 228 not only provide increased structural rigidity to the drawer sides 212, but also provide a thickness to the drawer sides 212 and an outer surface 230 onto which drawer slides (not pictured) may be mounted to connect the drawer 200, 200A to an inner surface of the sidewalls 106.

The drawer front wall 214 includes a pair of mounting flanges 232 on opposite sides to permit the drawer front 206 to be mounted to the drawer front wall 214 of the drawer body 208 by fasteners 234. Fasteners 234 are also used to connect the drawer sides 212 to the drawer front wall 214 and drawer back wall 216 when the drawer sides 212, the drawer front wall 214 and the drawer back wall 216 are folded up to the vertical orientations illustrated in FIGS. 24 and 25. The fasteners 234 are received in holes 236 when they are aligned.

The present invention has been described in relation to particular embodiments, which are intended in all respects to be illustrative rather than restrictive. Alternative embodiments will become apparent to those of ordinary skill in the art to which the present invention pertains without departing from its scope. For example, in another embodiment, a second pair of parallel and opposed downwardly depending flanges, similar to the flanges 186 and oriented generally perpendicular to the upper portion of the top wall, may added to the embodiment illustrated in FIG. 17A. The second pair of flanges would be perpendicular to the flanges 186, extend there between, and extend down into the top opening such that the second pair of flanges would be positioned adjacent to the front wall and the back wall, similar to the flanges 199A of the first pair of collar members 191. In yet another embodiment, additional flanges may be added around the periphery of the underside of the generally planar body 136, such that form outer flanges that circumscribe the upper portion of the front wall, back wall, and sidewalls and cooperate with the flanges described above that are positioned in the top opening to form channels that receive the upper portion of the cooperate with the collapsible subassembly 101.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

The invention claimed is:

1. A collapsible storage cabinet comprising:

a front wall;

an opposing back wall;

a pair of folding sidewalls extending between and coupling the front wall and the back wall, wherein the front wall, the back wall, and the pair of folding sidewalls define a collapsible subassembly having a top opening and a bottom opening;

a collar removably secured to one or more of the front wall, the back wall, and the pair of sidewalls, the collar at least partially circumscribing the top opening of the collapsible subassembly, the collar comprising:

a first pair of collar members having a planar body, the first pair of collar members each having a horizontal extension adjacent both ends of the planar body, and the first pair of collar members each having an insertion tab extending from the horizontal extensions and oriented perpendicular to the horizontal extensions; and a second pair of collar members having a planar body, the second pair of collar members each having a slot opening adjacent both ends of the planar body, wherein the insertion tabs of the first pair of collar members are positioned within the slot openings of the second pair of collar members to secure the first pair of collar members and the second pair of collar members together to form a continuous collar, wherein the first pair of collar members each include a downwardly depending flange extending within the top opening adjacent the front wall and the back wall, and the second pair of collar members each include a downwardly depending flange extending within the top opening adjacent the pair of sidewalls, the flanges being adjacent but not contacting one another and preventing the pair of folding sidewalls from folding; and a bottom wall positioned opposite the top wall and removably secured to one or more of a bottom edge of the front wall, a bottom edge of the back wall, and bottom edges of the pair of sidewalls, wherein a portion of the bottom wall is recessed within the bottom opening, and wherein the portion of the bottom wall recessed within the bottom opening prevents the sidewalls from folding.

2. The collapsible storage cabinet of claim 1, wherein the second pair of collar members each include a downwardly depending flange oriented perpendicular to the generally planar body of the second pair of collar members and which extend within the top opening, wherein the flanges of the second pair of collar members extending within the top opening prevents the sidewalls from folding.

3. The collapsible storage cabinet of claim 2, wherein the flanges of the second pair of collar members each comprise one or more openings that correspond to openings in the sidewalls.

4. The collapsible storage cabinet of claim 1, wherein the first pair of collar members each include a downwardly depending flange oriented perpendicular to the planar body of the first pair of collar members and which extend within the top opening adjacent the front wall and the back wall.

5. The collapsible storage cabinet of claim 4, wherein the flanges of the first pair of collar members each comprise one or more openings that correspond to openings in one of the front wall and the back wall.

* * * * *